US010134522B2

(12) United States Patent
Zhang et al.

(10) Patent No.: US 10,134,522 B2
(45) Date of Patent: Nov. 20, 2018

(54) PLANAR REACTOR

(71) Applicant: CYNTEC CO., LTD., Hsinchu (TW)

(72) Inventors: Wei Zhang, Shanghai (CN); Chu-Keng Lin, Hsinchu (TW); Hung-Chih Lin, Hsinchu (TW); Hsieh-Shen Hsieh, Hsinchu (TW)

(73) Assignee: CYNTEC CO., LTD., Hsinchu (TW)

( * ) Notice: Subject to any disclaimer, the term of this patent is extended or adjusted under 35 U.S.C. 154(b) by 74 days.

(21) Appl. No.: 15/046,423

(22) Filed: Feb. 17, 2016

(65) Prior Publication Data

US 2017/0154724 A1 Jun. 1, 2017

(30) Foreign Application Priority Data

Nov. 26, 2015 (CN) ..... 2015 1 0843640

(51) Int. Cl.

| | |
|---|---|
| ***H01F 27/08*** | (2006.01) |
| ***H01F 27/10*** | (2006.01) |
| ***H01F 27/02*** | (2006.01) |
| ***H01F 17/00*** | (2006.01) |
| ***H01F 17/06*** | (2006.01) |
| ***H01F 27/24*** | (2006.01) |
| ***H01F 27/34*** | (2006.01) |
| ***H01F 27/29*** | (2006.01) |

(52) U.S. Cl.
CPC ..... *H01F 27/341* (2013.01); *H01F 27/29* (2013.01)

(58) Field of Classification Search
CPC ..... H01F 27/341; H01F 27/29
USPC ..... 336/55–62, 83, 177–178, 205, 212, 219, 336/221
See application file for complete search history.

(56) References Cited

U.S. PATENT DOCUMENTS 2,849,696 A * 8/1958 Moynihan ..... H01F 27/245 336/212
3,007,125 A * 10/1961 Furbee ..... H01F 30/10 336/192
5,010,314 A 4/1991 Estrov
(Continued)

FOREIGN PATENT DOCUMENTS

CN 101840765 A 9/2010
CN 103426614 A 12/2013
(Continued)

OTHER PUBLICATIONS

Xianwen Chen, Shiyao Weng, "Electrical Equipment", China Railway Publisher, edition May 31, 1983, pp. 38-42.

*Primary Examiner* — Tsz Chan
(74) *Attorney, Agent, or Firm* — Winston Hsu

(57) ABSTRACT

A planar reactor includes a core and a coil. The core includes an upper board, a lower board and a pillar. The pillar is located between the upper board and the lower board. A winding space is located among the upper board, the lower board and the pillar. The coil is wound around the pillar and located in the winding space. The pillar and at least one of the upper board and the lower board are coplanar at a first side of the planar reactor. The pillar is sunk into the winding space from a second side of the planar reactor, wherein the first side is opposite to the second side. A first end of the coil is exposed from the first side of the planar reactor. A second end of the coil is hidden in the winding space partially or wholly at the second side of the planar reactor.

23 Claims, 24 Drawing Sheets

(56) References Cited

U.S. PATENT DOCUMENTS

| | | | | |
|---|---|---|---|---|
| 6,177,855 | B1 * | 1/2001 | Bouillot | H01F 3/14 336/100 |
| 6,204,744 | B1 | 3/2001 | Shafer | |
| 6,460,244 | B1 | 10/2002 | Shafer | |
| 7,129,809 | B2 | 10/2006 | Estrov | |
| 2002/0067237 | A1 * | 6/2002 | Nakata | H01F 27/29 336/212 |
| 2009/0237193 | A1 * | 9/2009 | Wedley | H01F 3/10 336/83 |
| 2010/0207714 | A1 | 8/2010 | Lai | |
| 2013/0120099 | A1 * | 5/2013 | An | H01F 27/266 336/221 |
| 2013/0207766 | A1 * | 8/2013 | Kim | H01F 3/14 336/170 |
| 2013/0314964 | A1 * | 11/2013 | Yoshikawa | H01F 37/00 363/131 |
| 2014/0140111 | A1 * | 5/2014 | Inaba | H01F 37/00 363/37 |

FOREIGN PATENT DOCUMENTS

| | | | | | |
|---|---|---|---|---|---|
| CN | 204680522 | U | | 9/2015 | |
| JP | 2004079640 | A | * | 3/2004 | |
| JP | 2007012891 | A | * | 1/2007 | |
| JP | 2010-219473 | A | | 9/2010 | |
| JP | WO 2014069312 | A1 | * | 5/2014 | H01F 37/00 |
| TW | I379329 | B1 | | 12/2012 | |
| TW | 201337980 | A | | 9/2013 | |

* cited by examiner

PLANAR REACTOR

BACKGROUND OF THE INVENTION

1. Field of the Invention

The invention relates to a reactor and, more particularly, to a planar reactor capable of reducing coil loss effectively.

2. Description of the Related Art

In electronic equipment, it is necessary to use a magnetic component to achieve filtering or energy storage for circuit design. For example, a reactor is applied to a variable-frequency drive or an inverter. To enhance operating efficiency or rotational speed (torque) of a motor, it tends to use the variable-frequency drive or the inverter to drive the motor. As technology advances and develops, the existing products are requested to be light, thin, short and small. Accordingly, a reactor with large current design, which is applied to the variable-frequency drive or the inverter, also has to be flatted. However, after flatting the reactor with a core, the thickness of upper/lower board of the reactor will decrease. Under magnetic flux conservation scheme, the width of the pillar of the core will also decrease. To satisfy the requirement of saturation current for the core, the pillar of the core must have a specific cross-sectional area. Therefore, the length of the pillar of the core will increase, such that the ratio of the length to the width of the pillar of the core will increase. If the ratio of the length to the width of the pillar of the core increases, the winding circumference of the coil will also increase, such that the cost and loss of the coil will increase correspondingly.

SUMMARY OF THE INVENTION

The invention provides a planar reactor capable of reducing coil loss effectively, so as to solve the aforesaid problems.

According to an embodiment of the invention, a planar reactor comprises a core and a coil. The core comprises an upper board, a lower board and a pillar. The pillar is located between the upper board and the lower board. A winding space is located among the upper board, the lower board and the pillar. The coil is wound around the pillar and located in the winding space. The pillar and at least one of the upper board and the lower board are coplanar at a first side of the planar reactor, and the pillar is sunk into the winding space from a second side of the planar reactor, wherein the first side is opposite to the second side. A first end of the coil is exposed from the first side of the planar reactor, and a second end of the coil is hidden in the winding space partially or wholly at the second side of the planar reactor, wherein the first end is opposite to the second end.

As mentioned in the above, since the pillar and at least one of the upper board and the lower board are coplanar at the first side of the planar reactor and the pillar is sunk into the winding space from the second side of the planar reactor, the width of the pillar can be increased and the length of the pillar can be decreased while the cross-sectional area of the pillar is constant. Accordingly, the ratio of the length to the width of the pillar will decrease. Therefore, the invention can flat the planar reactor and satisfy the requirement of saturation current for the core. Furthermore, since the ratio of the length to the width of the pillar decreases, the winding circumference of the coil will also decrease, so as to reduce the amount and loss of coil. Moreover, since one end of the coil can be hidden in the winding space partially or wholly, the invention can prevent the coil from protruding out of the core to occupy outside space.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
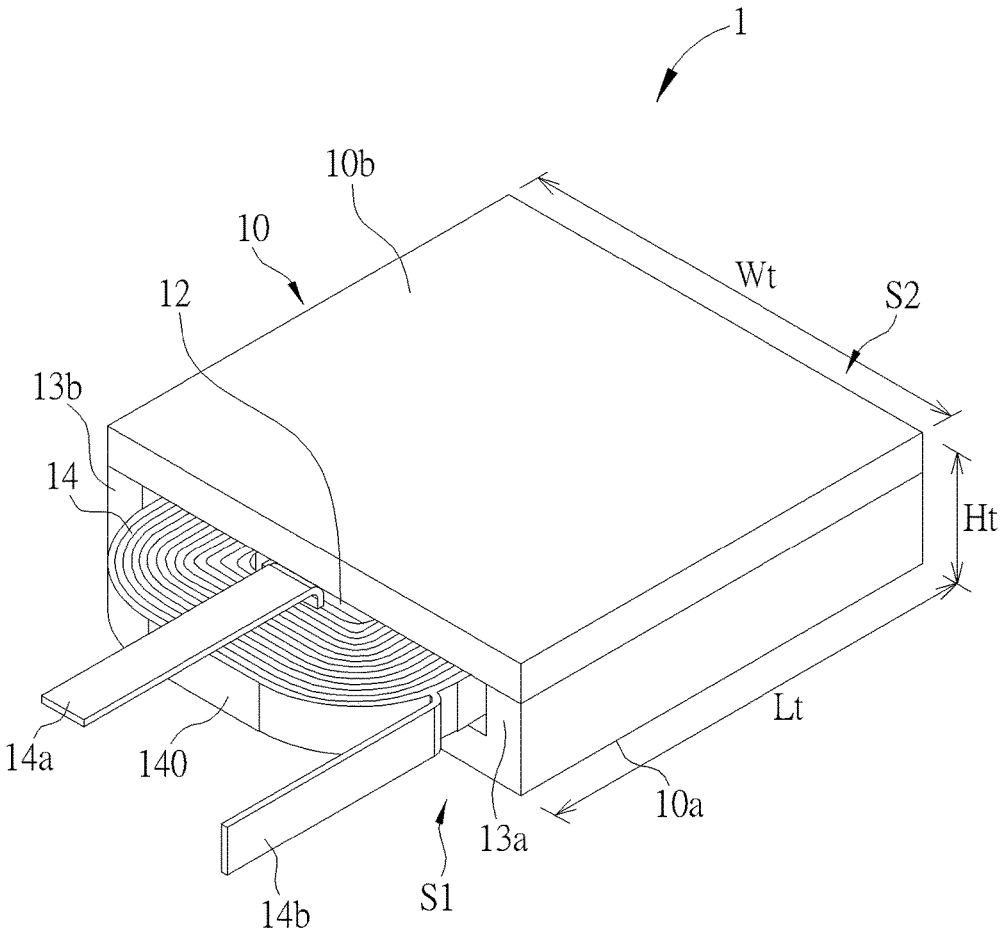
FIG. 1 is a perspective view illustrating a planar reactor according to an embodiment of the invention.
Figure 2:
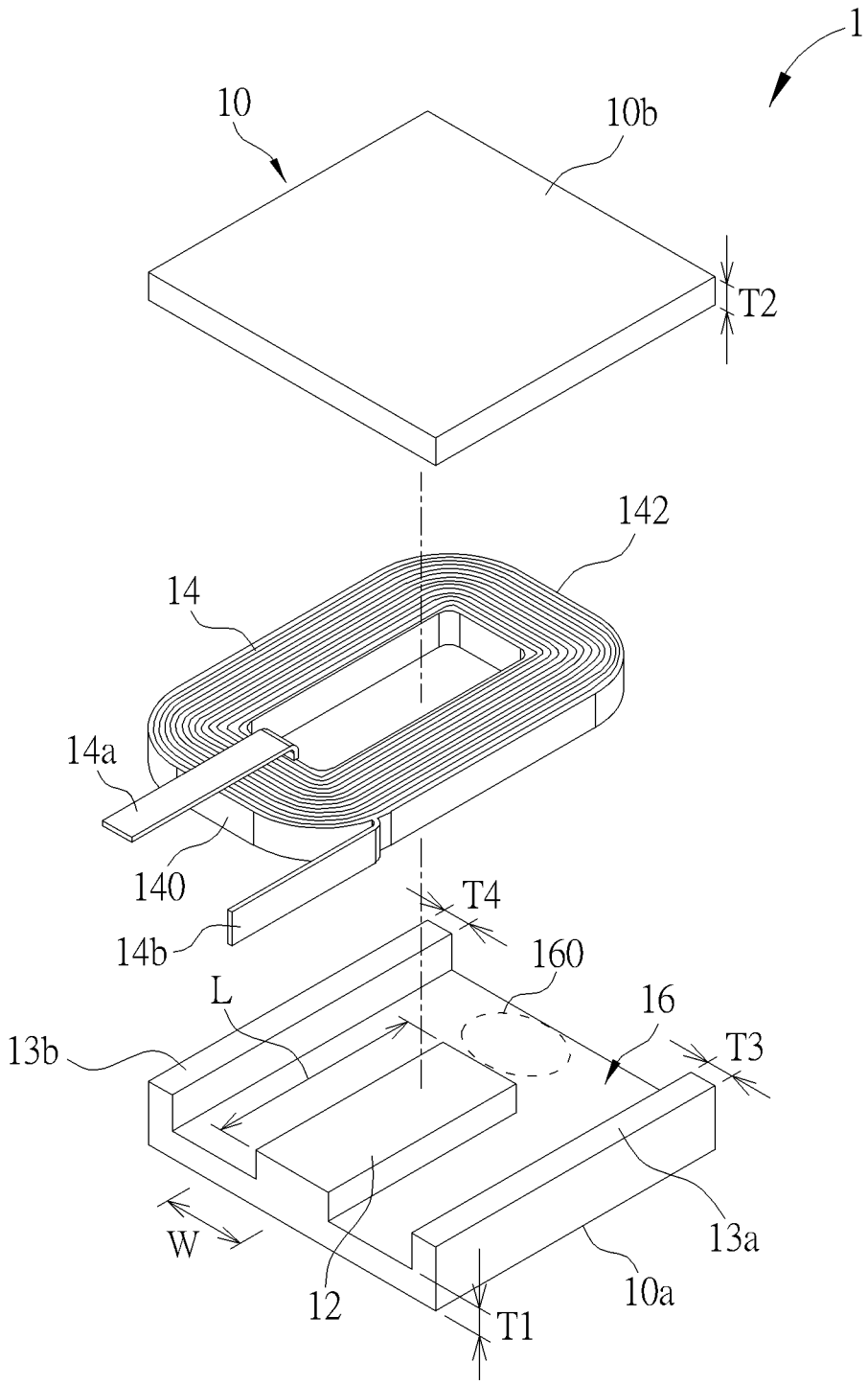
FIG. 2 is an exploded view illustrating the planar reactor shown in FIG. 1.
Figure 3:
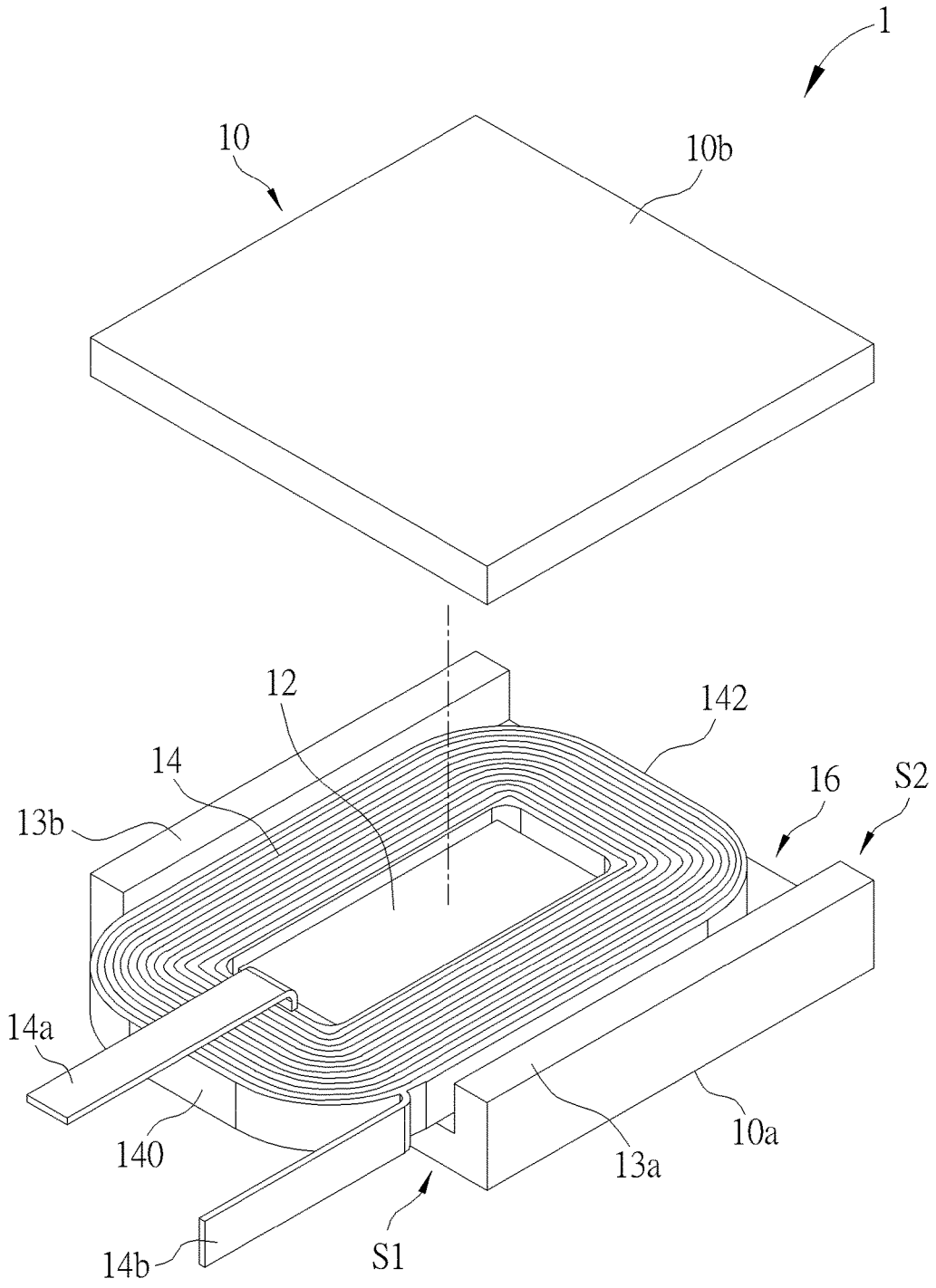
FIG. 3 is a perspective view illustrating the coil shown in FIG. 2 wound around the pillar and located in the winding space.
Figure 4:
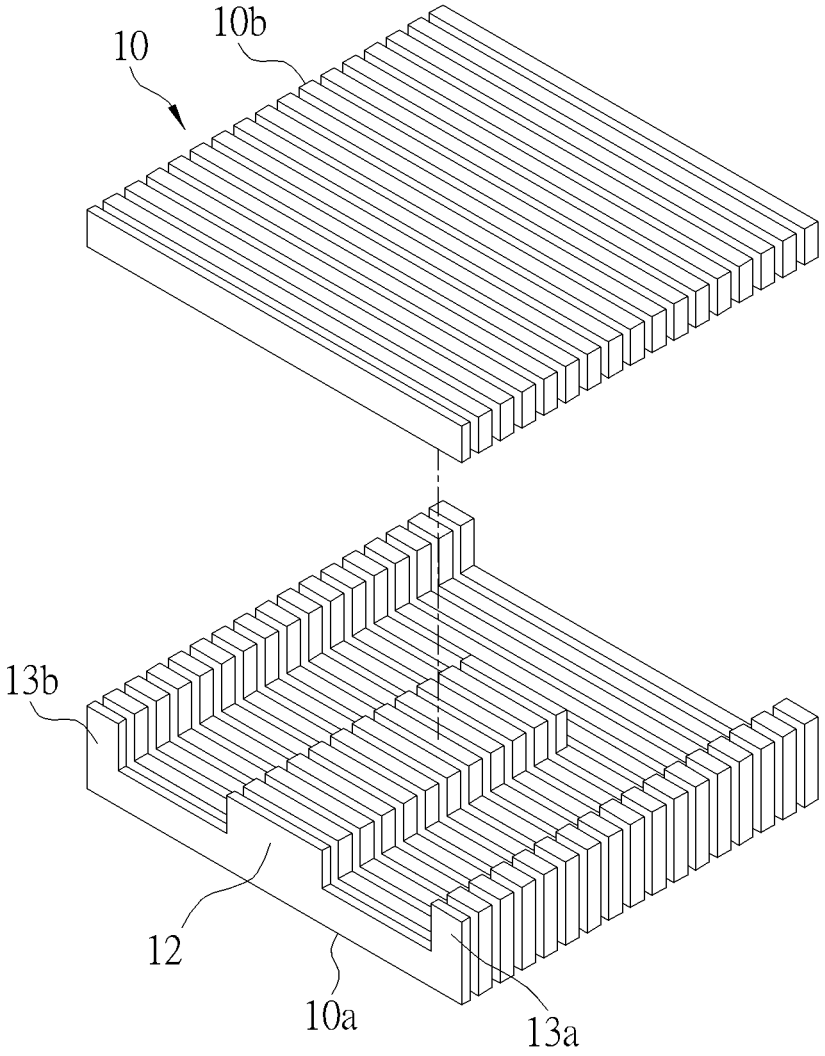
FIG. 4 is a schematic view illustrating the lower board, the upper board, the pillar, the first side wall and the second side wall shown in FIG. 2 manufactured by stacking a plurality of silicon steel sheets.

Referring to FIGS. 1 to 4, FIG. 1 is a perspective view illustrating a planar reactor 1 according to an embodiment of the invention, FIG. 2 is an exploded view illustrating the planar reactor 1 shown in FIG. 1, FIG. 3 is a perspective view illustrating the coil 14 shown in FIG. 2 wound around the pillar 12 and located in the winding space 16, and FIG. 4 is a schematic view illustrating the lower board 10*a*, the upper board 10*b*, the pillar 12, the first side wall 13*a* and the second side wall 13*b* shown in FIG. 2 manufactured by stacking a plurality of silicon steel sheets.

As shown in FIGS. 1 to 3, the planar reactor 1 comprises a core 10 and a coil 14. The core 10 comprises a lower board 10*a*, an upper board 10*b*, a pillar 12, a first side wall 13*a* and a second side wall 13*b*. The first side wall 13*a* and the second side wall 13*b* are located at opposite sides of the lower board 10*a*. The pillar 12 is located between the lower board 10*a* and the upper board 10*b* and located between the first side wall 13*a* and the second side wall 13*b*. A winding space 16 is located among the lower board 10*a*, the upper board 10*b*, the pillar 12, the first side wall 13*a* and the second side wall 13*b*. The coil 14 is wound around the pillar 12 and located in the winding space 16. In general, the core 10 of the planar reactor 1 essentially consists of the lower board 10*a*, the upper board 10*b*, the pillar 12, the first side wall 13*a* and the second side wall 13*b*. In this embodiment, the lower board 10*a*, the upper board 10*b*, the pillar 12, the first side wall 13*a* and the second side wall 13*b* may be manufactured by stacking a plurality of silicon steel sheets (as shown in FIG. 4). For example, the silicon steel sheets may be stacked in a direction from the first side S1 to the second side S2, so as to obtain better permeability. The coil 14 may be, but not limited to, copper wire. In this embodiment, the pillar 12, the first side wall 13*a* and the second side wall 13*b* may be formed with the lower board 10*a* integrally. However, in another embodiment, the pillar 12, the first side wall 13*a* and the second side wall 13*b* may also be formed with the upper board 10*a* integrally. In another embodiment, the pillar 12 may be formed with one of the lower board 10*a* and the upper board 10*b* integrally, and the first side wall 13*a* and the second side wall 13*b* may be formed with the other one of the lower board 10*a* and the upper board 10*b* integrally. In other words, the pillar 12, the first side wall 13*a* or the second side wall 13*b* may be formed with one of the lower board 10*a* and the upper board 10*b* integrally according to practical applications. It should be noted that, besides the E-I type shown in FIG. 2, the core 10 of the planar reactor 1 may also be formed as U-T type, F-L type, E-E type, symmetry type and so on, or T-I type without the first side wall 13*a* and the second side wall 13*b* according to practical applications.

As shown in FIGS. 1 and 2, the pillar 12, the lower board 10*a* and the upper board 10*b* are coplanar at a first side S1 of the planar reactor 1, and the pillar 12 is sunk into the winding space 16 from a second side S2 of the planar reactor 1, wherein the first side S1 is opposite to the second side S2. Since the pillar 12 is sunk into the winding space 16 from the second side S2 of the planar reactor 1, the winding space 16 comprises the sunk space 160 located at one side of the pillar 12 (as shown in FIG. 2). It should be noted that, in this embodiment, since the winding space 16 comprises the sunk space 160 located at one side of the pillar 12, the E core comprises a U-shaped portion corresponding to the sunk space 160. When the coil 14 is wound around the pillar 12, a first end 140 of the coil 14 is exposed from the first side S1 of the planar reactor 1, and a second end 142 of the coil 14 may be hidden in the winding space 16 partially or wholly at the second side S2 of the planar reactor 1, wherein the first end 140 is opposite to the second end 142. In this embodiment, the coil 14 may be a flat wire with an outside insulation layer and the cross-section of the coil 14 perpendicular to the current direction may be rectangular. Furthermore, the coil 14 of this embodiment is wound around the pillar 12 by long-side (horizontal direction) stacking. A wire end 14*a* inside the coil 14 is led out directly by passing through an outside surface of the pillar 12 and not passing through a lower surface of the upper board 10*b*. Accordingly, the height of the winding space 16 is decreased without the wire end 14*a*, such that the total height of the planar reactor 1 can be reduced. Moreover, another wire end 14*b* outside the coil 14 passes through the inner of the first side wall 13*a*. In another embodiment, the wire end 14*b* outside the coil 14 may also pass through the inner of the second side wall 13*b*.

Since the pillar 12, the lower board 10*a* and the upper board 10*b* are coplanar at the first side S1 of the planar reactor 1, and the pillar 12 is sunk into the winding space 16 from a second side S2 of the planar reactor 1, the width W of the pillar 12 can be increased and the length L of the pillar 12 can be decreased while the cross-sectional area of the pillar 12 is constant. Accordingly, the ratio of the length to the width L/W of the pillar 12 will decrease. Therefore, the invention may selectively make a vertical thickness T1 of the lower board 10*a* be smaller than a horizontal thickness T3 of the first side wall 13*a* or a horizontal thickness T4 of the second side wall 13*b*, or make a vertical thickness T2 of the upper board 10*b* be smaller than the horizontal thickness T3 of the first side wall 13*a* or the horizontal thickness T4 of the second side wall 13*b*, so as to reduce the total height of the planar reactor 1. Accordingly, the invention can flat the planar reactor 1 and satisfy the requirement of saturation current for the core. As shown in FIG. 1, the total height Ht of the planar reactor 1 is smaller than the total length Lt of the planar reactor 1 and/or the total width Wt of the planar reactor 1, wherein the ratio of Ht to Lt (Ht/Lt) and/or the ratio of Ht to Wt (Ht/Wt) may be between 1/20 and 1/2, such that the planar reactor 1 can be flatted effectively. Still further, since the ratio of the length to the width L/W of the pillar 12 decreases, the winding circumference of the coil 14 will also decrease, so as to reduce the amount and loss of coil (i.e. reduce the direct-current resistance $R_{dc}$). Moreover, since the second end 142 of the coil 14 can be hidden in the winding space 16 partially or wholly, the invention can prevent the coil 14 from protruding out of the core to occupy outside space.

Referring to Table 1 below, Table 1 records the relationship between the width W of the pillar 12, the direct-current resistance $R_{dc}$ of the planar reactor 1 and the ratio of the length L to the width W of the pillar 12. As shown in Table 1, when the width W of the pillar 12 is between 8 mm and 150 mm, the direct-current resistance $R_{dc}$ of the planar reactor 1 may be reduced to be smaller than or equal to 20.1 m Ohm (Ω) and the requirement of saturation current can be satisfied. Accordingly, the width W of the pillar 12 may be preferably between 8 mm and 150 mm. When the width W of the pillar 12 is between 8 mm and 150 mm, the ratio of the length L to the width W of the pillar 12 (i.e. L/W) is about between 68.438 and 0.195. Furthermore, when the width W of the pillar 12 is between 20 mm and 150 mm, the direct-current resistance $R_{dc}$ of the planar reactor 1 may be reduced to be smaller than or equal to 9.5 m Ohm. Accordingly, the width W of the pillar 12 may be preferably between 20 mm and 150 mm. When the width W of the pillar 12 is between 20 mm and 150 mm, the ratio of the length L to the width W of the pillar 12 (i.e. L/W) is about between 10.950 and 0.195. Moreover, a half of the width W of the pillar 12 (i.e. W/2) may be smaller than or equal to the vertical thickness T1 of the lower board 10*a* or the vertical thickness T2 of the upper board 10*b* (W/2≤T1 or W/2≤T2), or a half of the width W of the pillar 12 (i.e. W/2) may be smaller than or equal to the horizontal thickness T3 of the first side wall 13*a* or the horizontal thickness T4 of the second side wall 13*b* (W/2≤T3 or W/2≤T4)

TABLE 1

| Width W of pillar 12 (mm) | Direct-current resistance $R_{dc}$ of planar reactor 1 (m Ohm) | Ratio of length L to width W of pillar 12 (L/W) |
|---|---|---|
| 8 | 20.1 | 68.438 |
| 15 | 11.8 | 19.467 |
| 20 | 9.5 | 10.950 |
| 25 | 8.2 | 7.008 |
| 30 | 7.4 | 4.867 |
| 35 | 6.8 | 3.576 |
| 40 | 6.5 | 2.738 |
| 45 | 6.2 | 2.163 |
| 50 | 6.1 | 1.752 |
| 55 | 6.0 | 1.448 |
| 60 | 5.9 | 1.217 |
| 65 | 5.9 | 1.037 |
| 70 | 5.9 | 0.894 |
| 75 | 5.9 | 0.779 |
| 80 | 6.0 | 0.684 |
| 85 | 6.1 | 0.606 |
| 90 | 6.1 | 0.541 |
| 95 | 6.2 | 0.485 |
| 100 | 6.3 | 0.438 |
| 105 | 6.4 | 0.397 |
| 110 | 6.5 | 0.362 |
| 115 | 6.6 | 0.331 |
| 120 | 6.7 | 0.304 |
| 125 | 6.8 | 0.280 |
| 130 | 7.0 | 0.259 |
| 135 | 7.1 | 0.240 |
| 140 | 7.2 | 0.223 |
| 145 | 7.3 | 0.208 |
| 150 | 7.5 | 0.195 |

Figure 5:
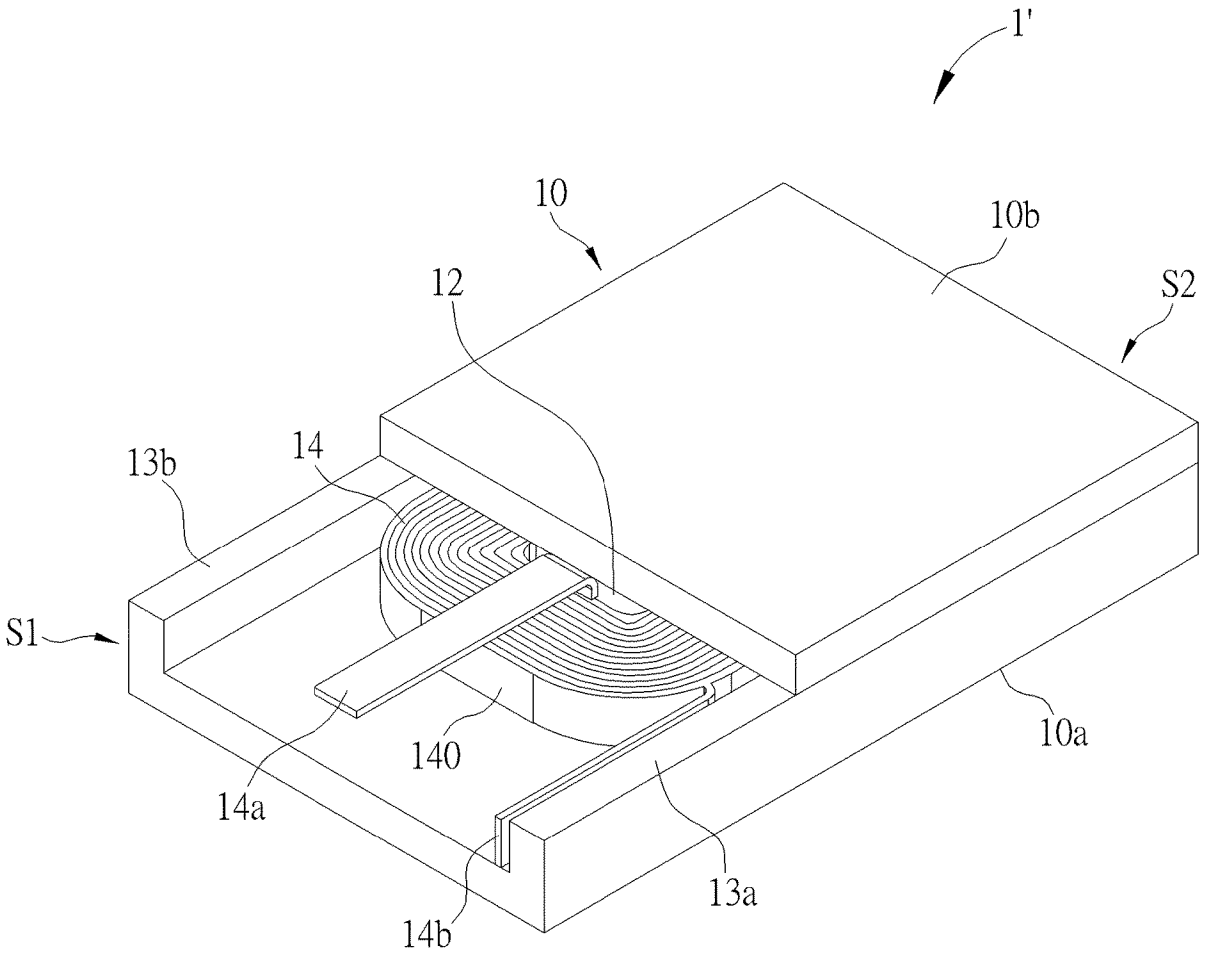
FIG. 5 is a perspective view illustrating a planar reactor according to another embodiment of the invention.
Figure 6:
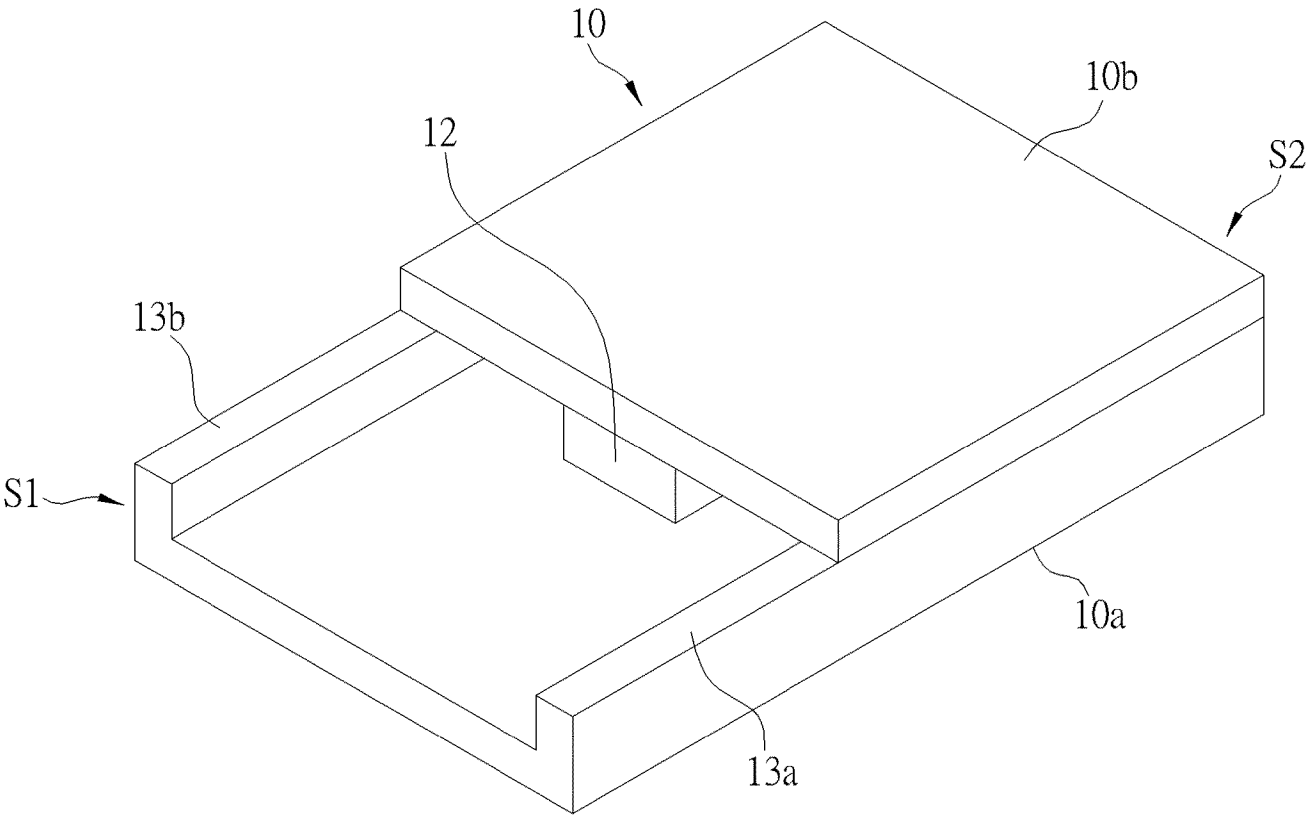
FIG. 6 is a perspective view illustrating the coil shown in FIG. 5 removed from the planar reactor.

Referring to FIGS. 5 and 6, FIG. 5 is a perspective view illustrating a planar reactor 1' according to another embodiment of the invention, and FIG. 6 is a perspective view illustrating the coil 14 shown in FIG. 5 removed from the planar reactor 1'. As shown in FIGS. 5 and 6, the lower board 10*a* may extend to overlap with the first end 140 of the coil 14, and the pillar 12 and the upper board 10*b* are coplanar at the first side S1 of the planar reactor 1'. Since the lower board 10*a* overlaps with the first end 140 of the coil 14, the heat generated by the coil 14 may be conducted to a package casing (not shown) or outside through the lower board 14*a*, so as to enhance thermal diffusivity and temperature uniformity of the planar reactor 1'. Compared to the planar reactor 1 shown in FIG. 1, the first end 140 of the coil 14 of the planar reactor 1' is only exposed above the first side S1 of the planar reactor 1' (as shown in FIG. 5). It should be noted that the same elements in FIGS. 5-6 and FIGS. 1-3 are represented by the same numerals, so the repeated explanation will not be depicted herein again.

Figure 7:
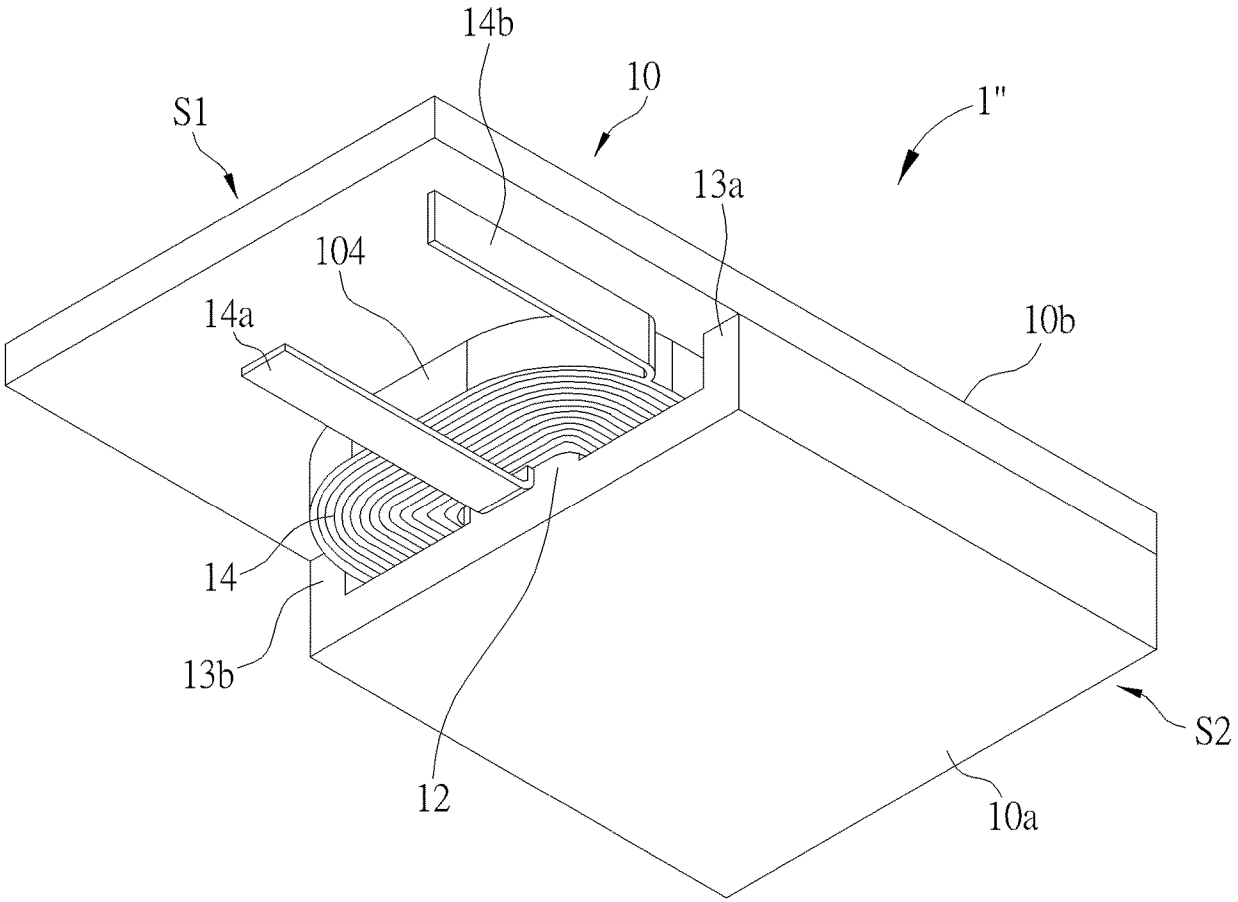
FIG. 7 is a perspective view illustrating a planar reactor according to another embodiment of the invention.
Figure 8:
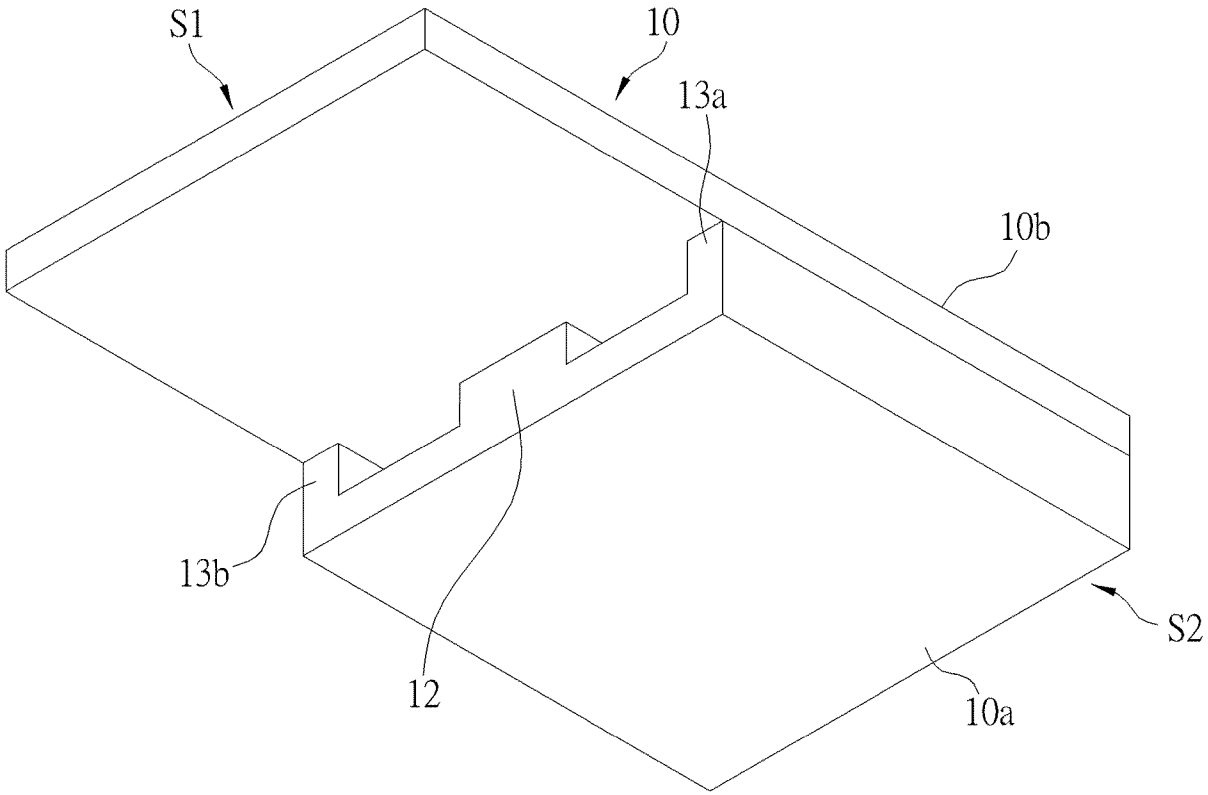
FIG. 8 is a perspective view illustrating the coil shown in FIG. 7 removed from the planar reactor.

Referring to FIGS. 7 and 8, FIG. 7 is a perspective view illustrating a planar reactor 1" according to another embodiment of the invention, and FIG. 8 is a perspective view illustrating the coil 14 shown in FIG. 7 removed from the planar reactor 1". As shown in FIGS. 7 and 8, the upper board 10*b* may extend to overlap with the first end 140 of the coil 14, and the pillar 12 and the lower board 10*a* are coplanar at the first side S1 of the planar reactor 1". Since the upper board 10*b* overlaps with the first end 140 of the coil 14, the heat generated by the coil 14 may be conducted to a package casing (not shown) or outside through the upper board 14*b*, so as to enhance thermal diffusivity and temperature uniformity of the planar reactor 1". Compared to the planar reactor 1 shown in FIG. 1, the first end 140 of the coil 14 of the planar reactor 1" is only exposed below the first side S1 of the planar reactor 1" (as shown in FIG. 7). It should be noted that the same elements in FIGS. 7-8 and FIGS. 1-3 are represented by the same numerals, so the repeated explanation will not be depicted herein again.

Figure 9:
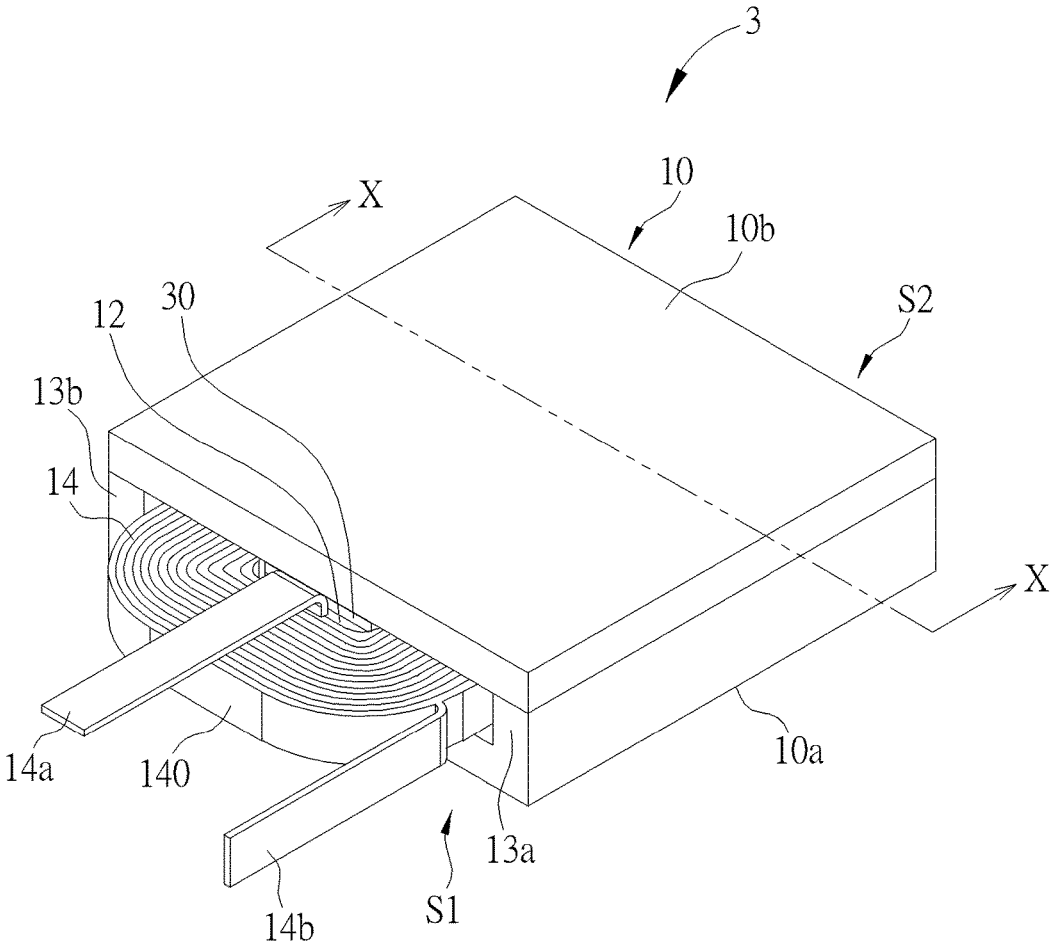
FIG. 9 is a perspective view illustrating a planar reactor according to another embodiment of the invention.
Figure 10:
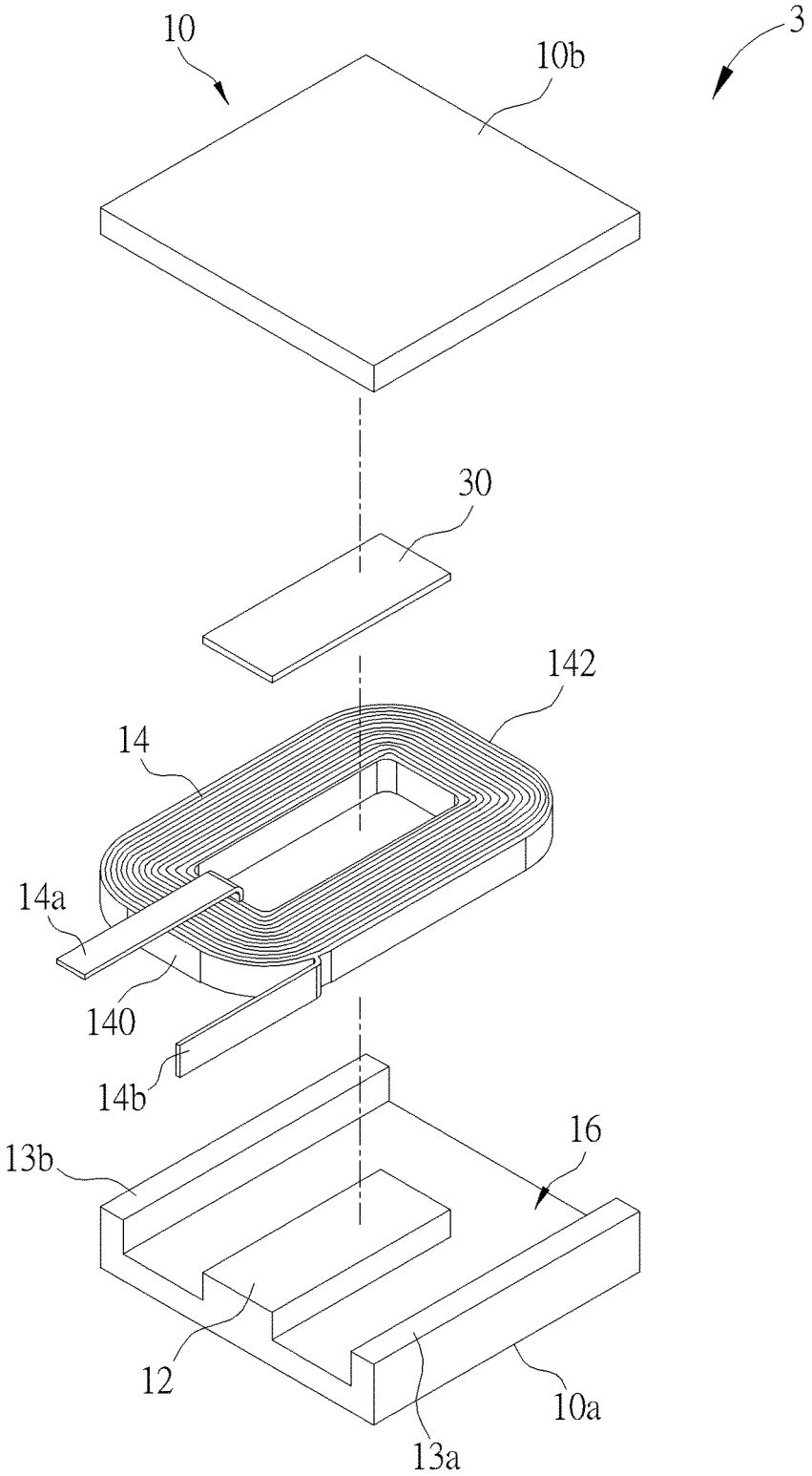
FIG. 10 is an exploded view illustrating the planar reactor shown in FIG. 9.
Figure 11:
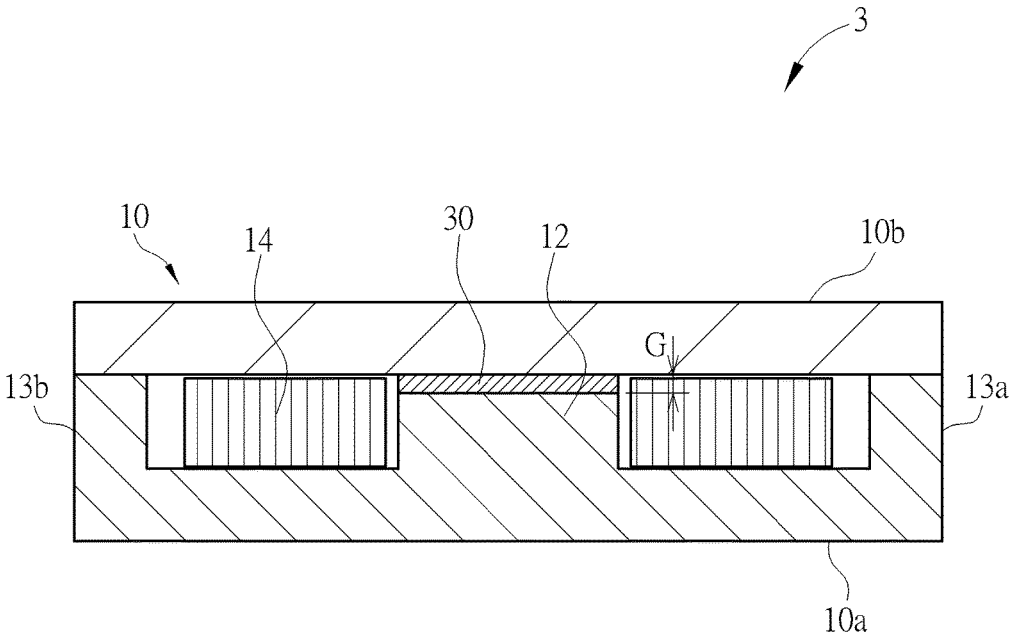
FIG. 11 is a cross-sectional view illustrating the planar reactor shown in FIG. 9 along line X-X.

Referring to FIGS. 9 to 11, FIG. 9 is a perspective view illustrating a planar reactor 3 according to another embodiment of the invention, FIG. 10 is an exploded view illustrating the planar reactor 3 shown in FIG. 9, and FIG. 11 is a cross-sectional view illustrating the planar reactor 3 shown in FIG. 9 along line X-X. The main difference between the planar reactor 3 and the aforesaid planar reactor 1 is that the planar reactor 3 further comprises an air gap sheet 30, as shown in FIGS. 9 to 11. In this embodiment, the pillar 12 and the lower board 10*a* are formed integrally and an air gap G exists between the pillar 12 and the upper board 10*b*. The air gap G may be located at any positions on the pillar 12 between the upper board 10*b* and the lower board 10*a*, e.g. the lower surface of the upper board 10*b*, the upper surface of the lower board 10*a*, or the middle between the upper board 10*b* and the lower board 10*a*. For example, the height of the pillar 12 extending from the lower board 10*a* upwardly nay be smaller than the height of the first side wall 13*a* and the second side wall 13*b* extending from the lower board 10*a* upwardly, such that an air gap G exists between the pillar 12 and the upper board 10*b*, i.e. the air gap G may be located at the lower surface of the upper board 10*b*. In another embodiment, when the core is formed as E-E type, the air gap G may be located at the middle of the pillar 12. Since noise, e.g. murmur sounds, will be generated at the air gap G as the planar reactor 3 is working, the invention may dispose the air gap sheet 30 in the air gap G, so as to reduce noise. Preferably, opposite sides of the air gap sheet 30 may contact the upper and lower surfaces of the air gap G by bonding, adhesion or force fit, respectively. In this embodiment, opposite sides of the air gap sheet 30 contact the pillar 12 and the upper board 10*b*, respectively. In this embodiment, the air gap sheet 30 may be made of insulation material, non-magnetic material or soft material (e.g. plastic). It should be noted that the same elements in FIGS. 9-11 and FIGS. 1-3 are represented by the same numerals, so the repeated explanation will not be depicted herein again.

Figure 12:
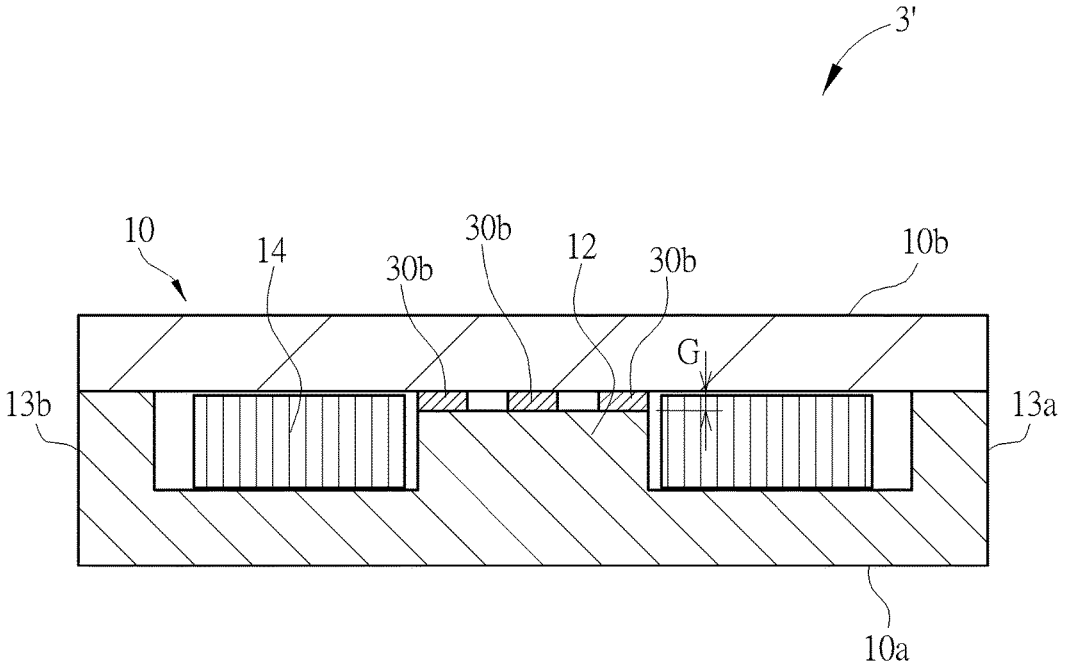
FIG. 12 is a cross-sectional view illustrating a planar reactor according to another embodiment of the invention.

Referring to FIG. 12, FIG. 12 is a cross-sectional view illustrating a planar reactor 3' according to another embodiment of the invention. The main difference between the planar reactor 3' and the aforesaid planar reactor 3 is that the planar reactor 3' comprises a plurality of air gap sheets 30*b*. As shown in FIG. 12, the invention may dispose a plurality of air gap sheets 30*b* in the air gap G separately, so as to reduce noise. The number and position of the air gap sheets 30*b* may be determined according to practical applications and not limited to the embodiment shown in FIG. 12. It should be noted that the same elements in FIG. 12 and FIG. 11 are represented by the same numerals, so the repeated explanation will not be depicted herein again.

Figure 13:
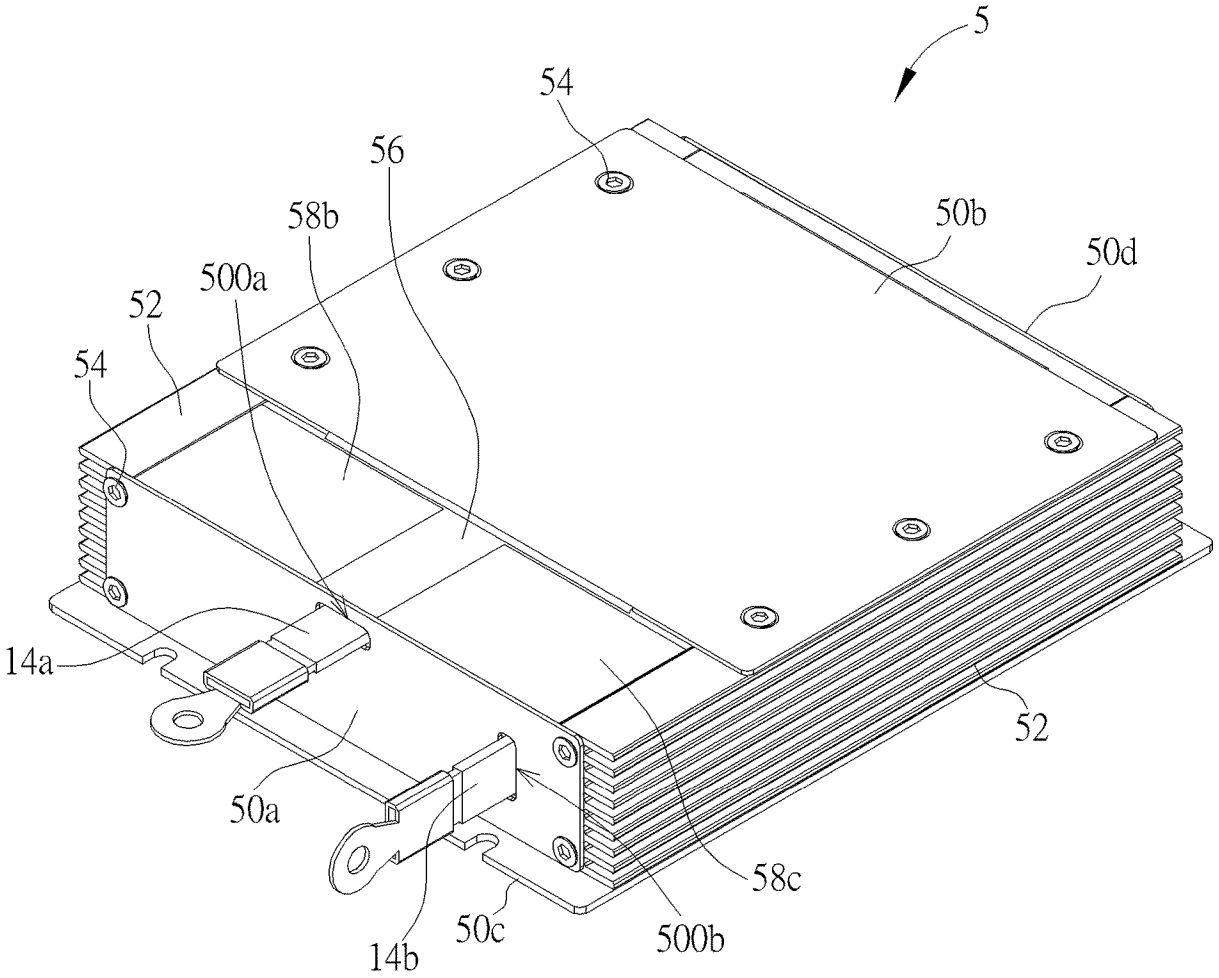
FIG. 13 is a perspective view illustrating a planar reactor according to another embodiment of the invention.
Figure 14:
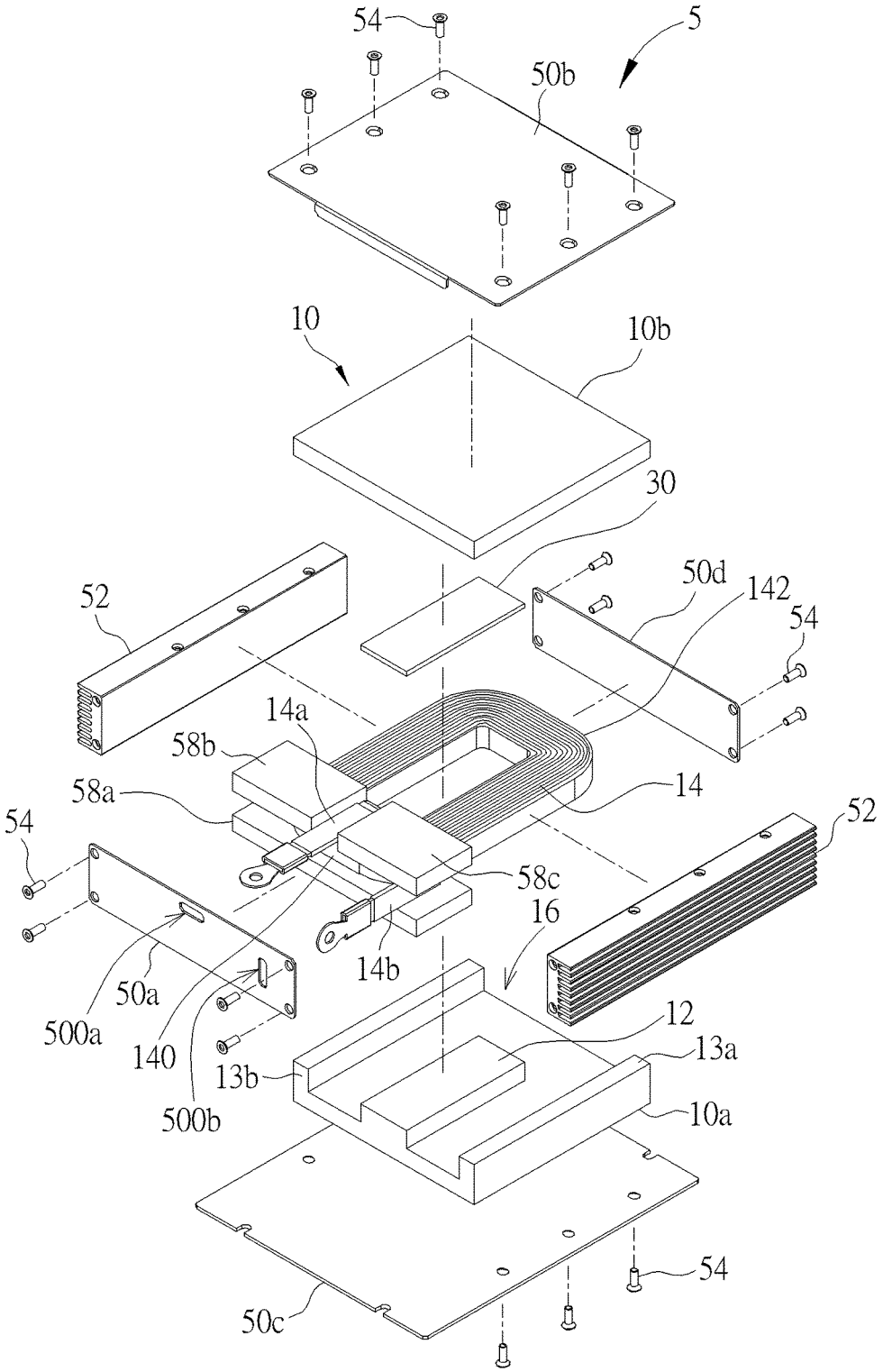
FIG. 14 is an exploded view illustrating the planar reactor shown in FIG. 13.
Figure 15:
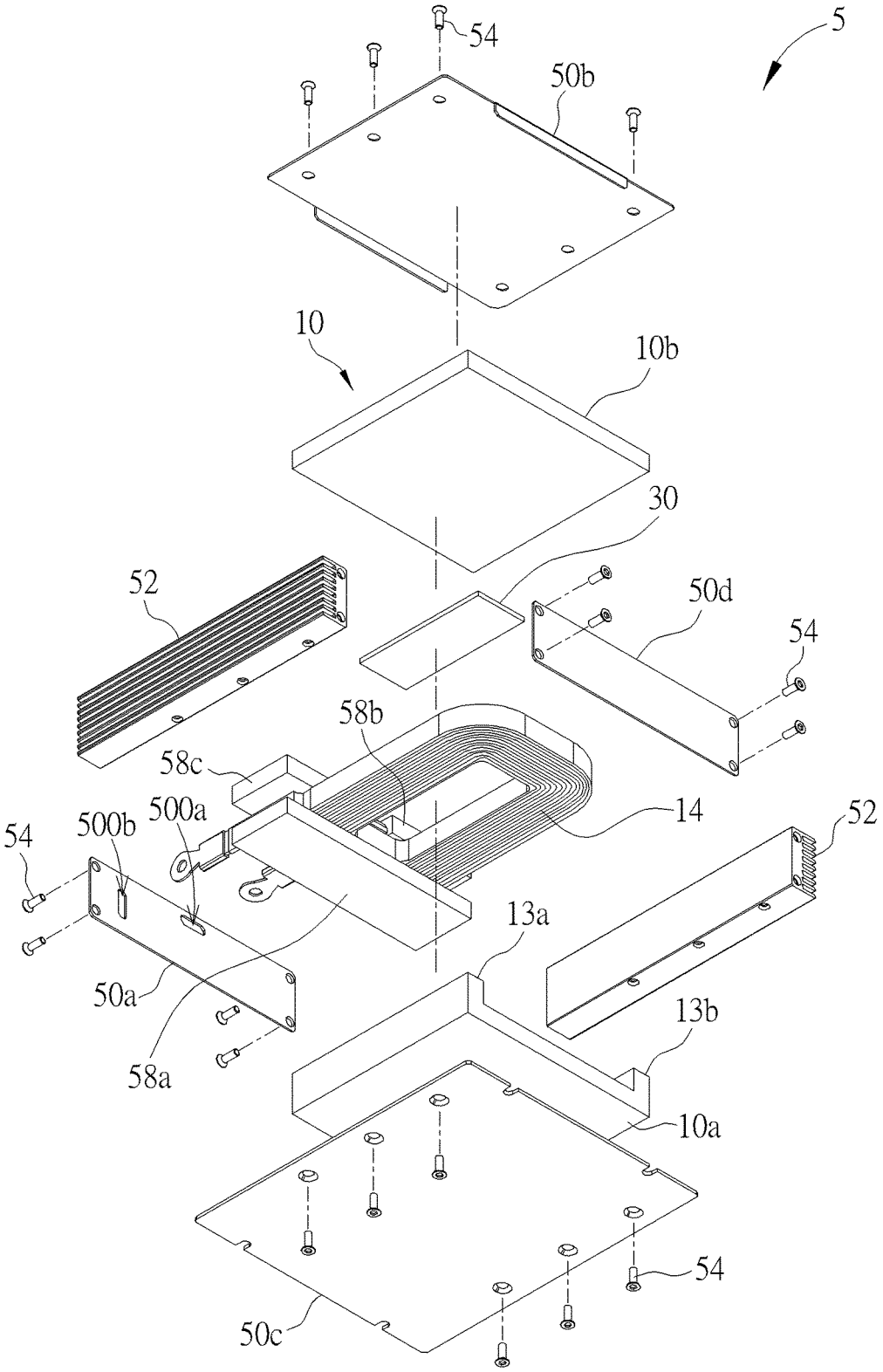
FIG. 15 is an exploded view illustrating the planar reactor shown in FIG. 13 from another viewing angle.

Referring to FIGS. 13 to 15, FIG. 13 is a perspective view illustrating a planar reactor 5 according to another embodiment of the invention, FIG. 14 is an exploded view illustrating the planar reactor 5 shown in FIG. 13, and FIG. 15 is an exploded view illustrating the planar reactor 5 shown in FIG. 13 from another viewing angle. The main difference between the planar reactor 5 and the aforesaid planar reactor 1 is that the planar reactor 5 further comprises the aforesaid air gap sheet 30, a first side board 50*a*, a second side board 50*b*, a third side board 50*c*, a fourth side board 50*d*, two heat sinks 52, a plurality of screws 54, a pouring sealant 56 and three heat conducting members 58*a*, 58*b*, 58*c*. After assembling the lower board 10*a*, the upper board 10*b*, the coil 14, the air gap sheet 30, the first side board 50*a*, the second side board 50*b*, the third side board 50*c*, the fourth side board 50*d*, the heat sinks 52, the screws 54 and the heat conducting members 58*a*, 58*b*, 58*c*, the pouring sealant 56 is poured into a space formed between the first side board 50*a*, the second side board 50*b*, the third side board 50*c* and the fourth side board 50*d*, wherein the space comprises the winding space 16 and an outside space extended from the winding space 16. Accordingly, the space around the coil 14 and the heat conducting members 58*a*, 58*b*, 58*c* is filled with the pouring sealant 56, so as to seal the coil 14 and the heat conducting members 58*a*, 58*b*, 58*c*. The coil 14 and the heat conducting members 58*a*, 58*b*, 58*c* do not contact each other directly and the pouring sealant 56 is located between the coil 14 and the heat conducting members 58*a*, 58*b*, 58*c*. Accordingly, the insulation characteristic between the heat conducting members 58*a*, 58*b*, 58*c* and the coil 14 will get better. The heat generated by the coil 14 in the winding space 16 can be conducted to a package casing (not shown) or outside through the pouring sealant 56 and the heat conducting members 58*a*, 58*b*, 58*c* with better thermal conductivity, so as to enhance heat dissipation.

The arrangement and principle of the lower board 10*a*, the upper board 10*b*, the coil 14 and the air gap sheet 30 are mentioned in the above, so those will not be depicted herein again.

The wire ends 14*a*, 14*b* of the coil 14 may be led out from the wire holes 500*a*, 500*b* of the first side board 50*a*, respectively. The heat conducting members 58*a*, 58*b*, 58*c* may be formed with one of the first side board 50*a*, the second side board 50*b* and the third side board 50*c* integrally. The heat conducting members 58*a*, 58*b*, 58*c* may also be fixed on one of the first side board 50*a*, the second side board 50*b* and the third side board 50*c* (e.g. fixed by screws). To enhance insulation and voltage withstanding characteristics (e.g. larger than 2.5 k V), the coil does not contact the heat conducting members 58*a*, 58*b*, 58*c* directly and selectively, and the pouring sealant 56 is located between the coil 14 and the heat conducting members 58*a*, 58*b*, 58*c*. There is a safety distance between the coil 14 and the heat conducting members 58*a*, 58*b*, 58*c* and the pouring sealant 56 may be made of a material with better insulation characteristic. The heat generated by the coil 14 in the winding space 16 can be conducted to a package casing (not shown) or outside through the pouring sealant 56, any or all of the heat conducting members 58*a*, 58*b*, 58*c*, the first side board 50*a*, the second side board 50*b* and the third side board 50*c* in order. The heat conducting members 58*a*, 58*b*, 58*c* may be rectangular or other suitable shapes according to practical applications. The two heat sinks 52 may be disposed at opposite sides of the core consisting of the lower board 10*a*, the upper board 10*b* and the pillar 12. In other words, the two heat sinks 52 may be disposed outside the planar reactor 5. The invention may form a plurality of screw holes on the two heat sinks 52, the first side board 50*a*, the second side board 50*b*, the third side board 50*c* and the fourth side board 50*d*, such that the screws 54 can fix and join the first side board 50*a*, the second side board 50*b*, the third side board 50*c* and the fourth side board 50*d* with the two heat sinks 52 by the screw holes and at least one surface of the two heat sinks 52 contacts the first side wall 13*a* or the second side wall 13*b*, so as to complete the assembly of the planar reactor 5 shown in FIG. 13. In this embodiment, the heat sink 52 may further has a plurality of heat dissipating fins for enhancing heat dissipation.

In general, the coil 14 is a main heat source of the planar reactor 5. Since a thermal conductivity of the core consisting of the lower board 10*a*, the upper board 10*b* and the pillar 12 (larger than about 10 W/mk) is larger than a thermal conductivity of the pouring sealant 56 (about 0.2 W/mk to 3 W/mk), the pouring sealant 56 will increase heat transfer impedance. The invention may dispose the heat conducting members 58*a*, 58*b*, 58*c* at the first end 140 of the coil 14, so as to reduce heat transfer impedance effectively, wherein the heat conducting member 58*a* may be disposed at one side of the first end 140 of the coil 14 and the heat conducting members 58*b*, 58*c* may be disposed at the other side of the first end 140 of the coil 14. Preferably, the thermal conductivity of the heat conducting members 58*a*, 58*b*, 58*c* may be between 100 W/mk and 400 W/mk. Furthermore, the heat conducting members 58*a*, 58*b*, 58*c* may be made of, but not limited to, thermal conductive plastic, aluminum, ceramic or graphite. It should be noted that the heat conducting members 58*b*, 58*c* may also be formed integrally, so the heat conducting members 58*b*, 58*c* are not limited to two single pieces. Moreover, the invention may only dispose the heat conducting member 58*a* at one side of the first end 140 of the coil 14 without disposing the heat conducting members 58*b*, 58*c* at the other side of the first end 140 of the coil 14. The thermal conductivity of the heat conducting members 58*a*, 58*b*, 58*c* is larger than the thermal conductivity of the pouring sealant 56.

Referring to Table 2 below, Table 2 shows temperature simulation results of different embodiments of the invention. The simulation conditions of Table 2 are set as follows: (1) analysis type: steady state; (2) convection velocity: 3 m/s; (3) coil loss: 102 W; core loss: 4.44 W; and (5) environmental temperature: 50° C.

TABLE 2

| Heat conducting member | Embodiment A None | Embodiment B Only dispose heat conducting member at one side of the first end 140 of the coil 14 | Temperature difference between embodiments B and A |
|---|---|---|---|
| Maximum temperature of coil | 140.2° C. | 134.9° C. | −5.3° C. |
| Maximum temperature of core | 125.7° C. | 122.5° C. | −3.2° C. |

| Heat conducting member | Embodiment A None | Embodiment C Dispose heat conducting members at opposite sides of the first end 140 of the coil 14 | Temperature difference between embodiments C and A |
|---|---|---|---|
| Maximum temperature of coil | 140.2° C. | 130.0° C. | −10.2° C. |
| Maximum temperature of core | 125.7° C. | 119.1° C. | −6.6° C. |

As shown in Table 2, when the heat conducting member is disposed at the first end 140 of the coil 14, thermal diffusivity and temperature uniformity of the planar reactor 5 can be enhanced effectively.

Figure 16:
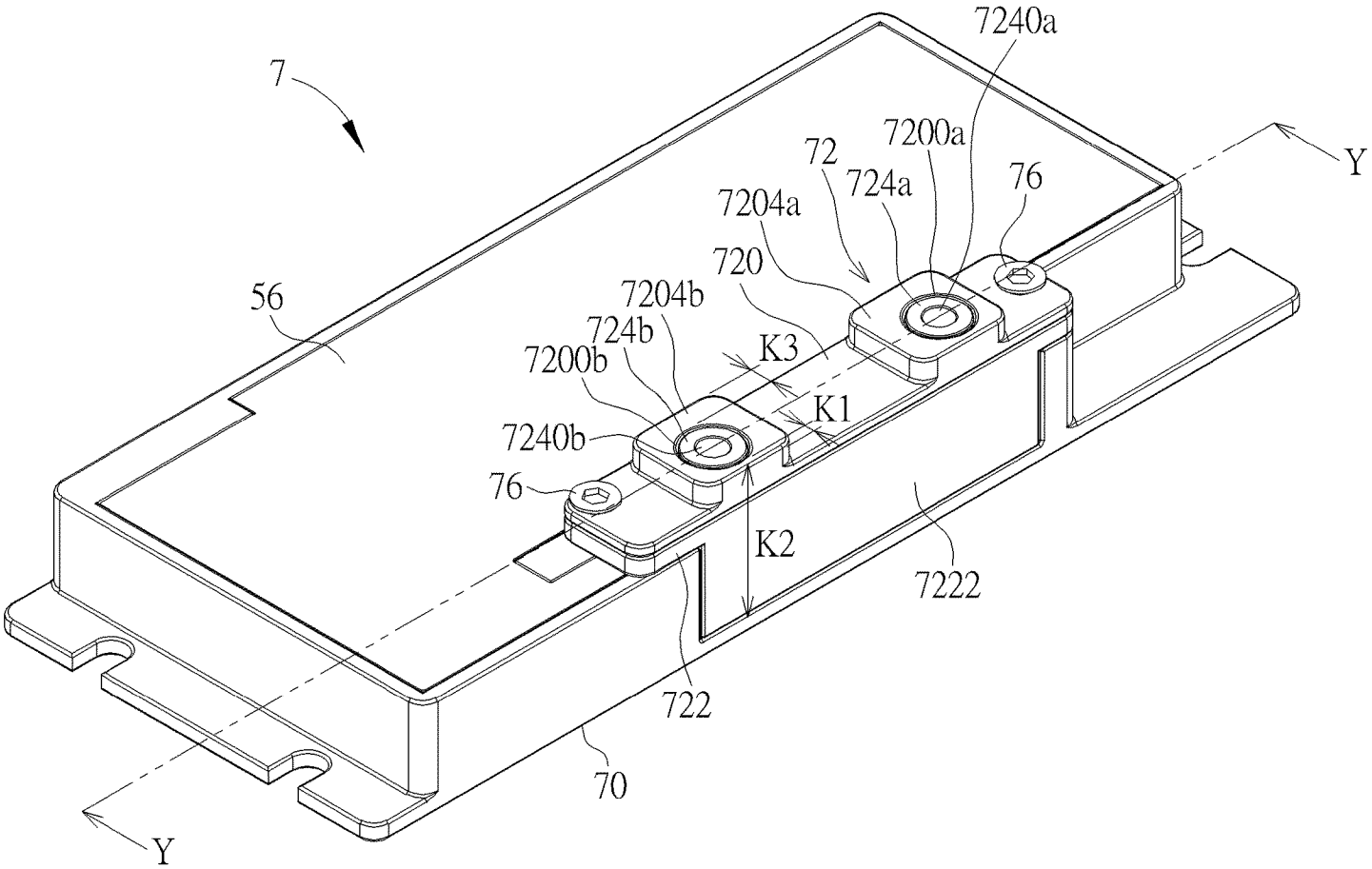
FIG. 16 is a perspective view illustrating a planar reactor according to another embodiment of the invention.
Figure 17:
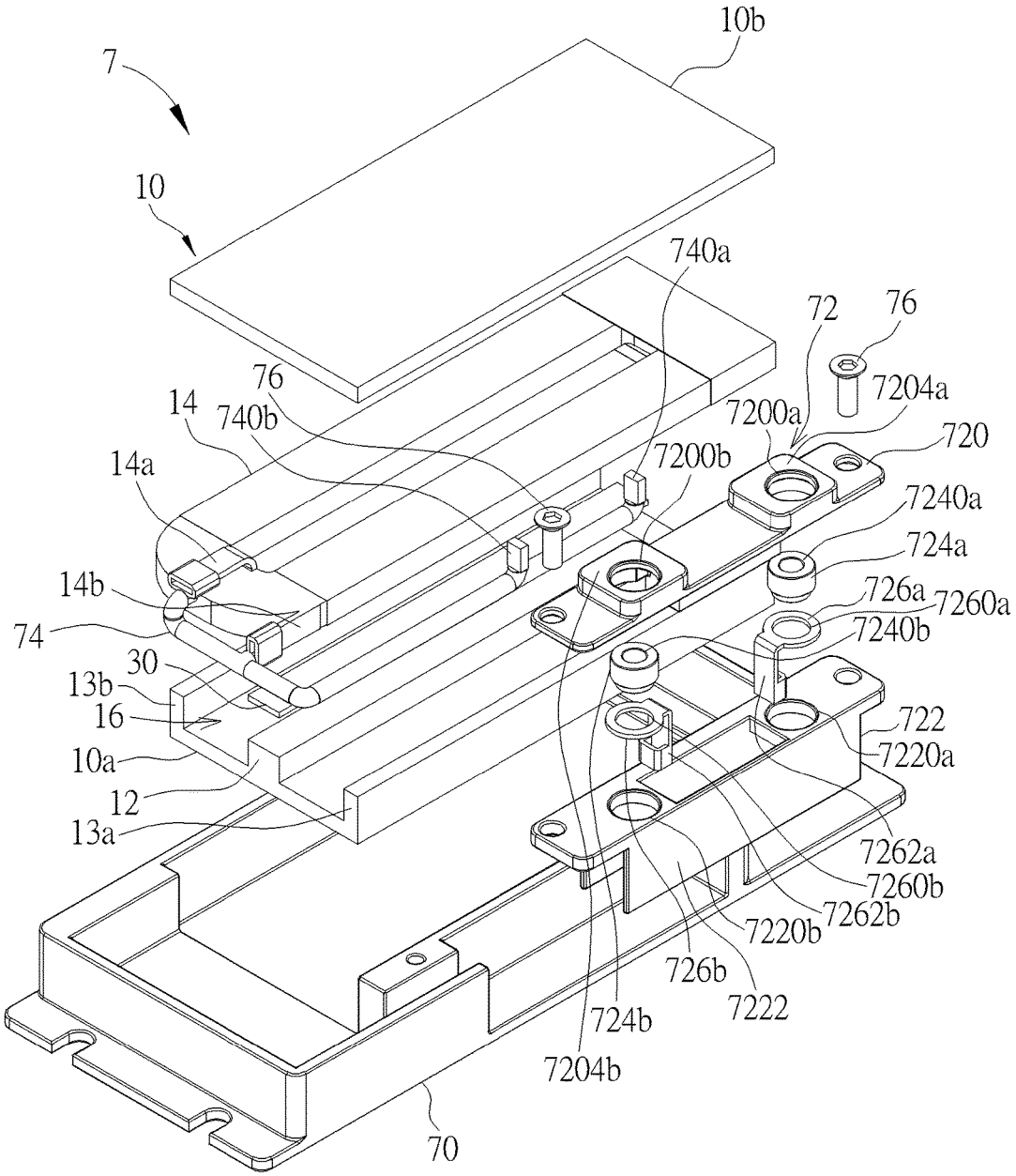
FIG. 17 is an exploded view illustrating the planar reactor shown in FIG. 16.
Figure 18:
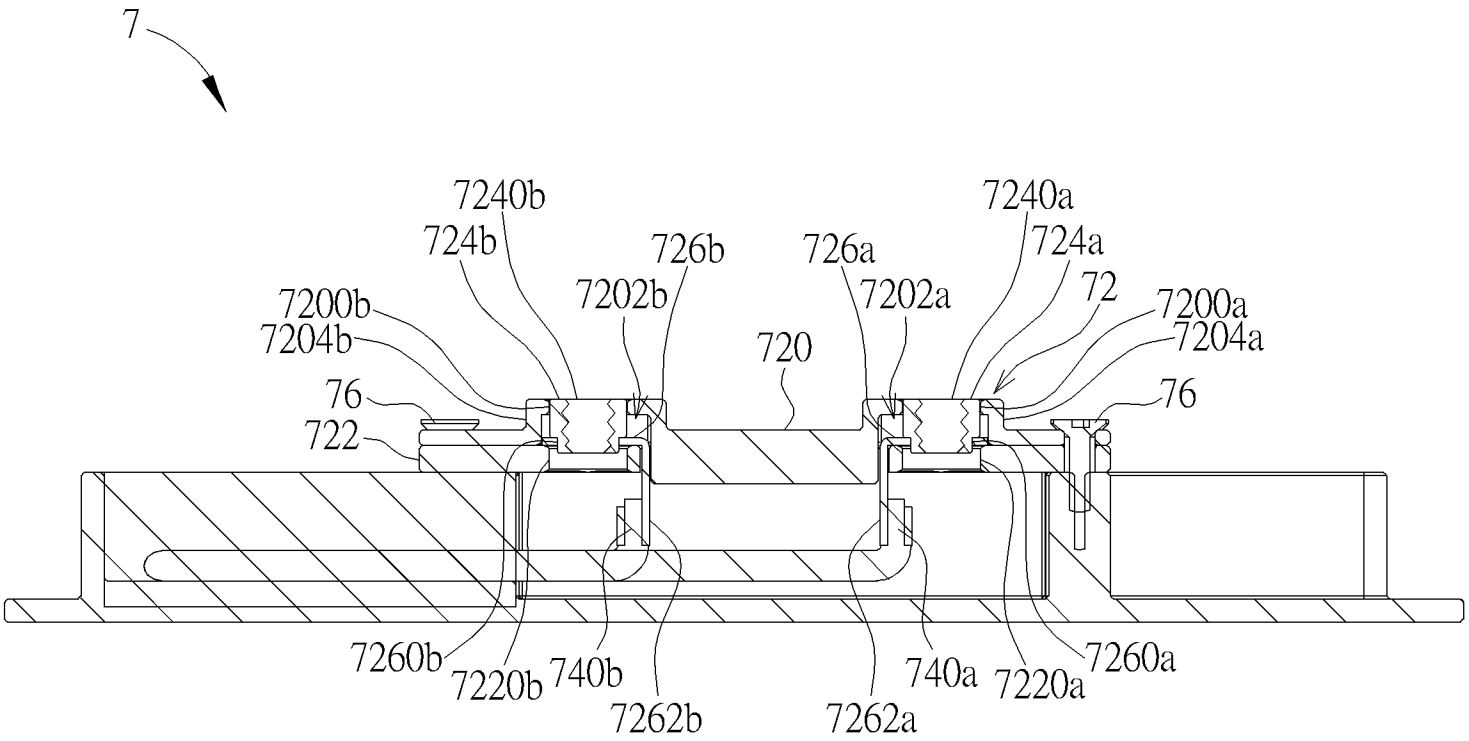
FIG. 18 is a cross-sectional view illustrating the planar reactor shown in FIG. 16 along line Y-Y.

Referring to FIGS. 16 to 18, FIG. 16 is a perspective view illustrating a planar reactor 7 according to another embodiment of the invention, FIG. 17 is an exploded view illustrating the planar reactor 7 shown in FIG. 16, and FIG. 18 is a cross-sectional view illustrating the planar reactor 7 shown in FIG. 16 along line Y-Y. As shown in FIGS. 16 to 18, the planar reactor 7 comprises a core 10, a coil 14, an air gap sheet 30, a pouring sealant 56, a package casing 70, a terminal base 72 and a connecting wire 74, wherein the core 10 comprises a lower board 10*a*, an upper board 10*b*, a pillar 12, a first side wall 13*a* and a second side wall 13*b*. It should be noted that the arrangement and principle of the lower board 10*a*, the upper board 10*b*, the pillar 12, the first side wall 13*a* and the second side wall 13*b* are mentioned in the above, so those will not be depicted herein again.

In this embodiment, the terminal base 72 comprises an upper base 720, a lower base 722, two first terminals 724*a*, 724*b* and two second terminals 726*a*, 726*b*. An end of the first terminal 724*a* may be jointed with a hole 7260*a* of the second terminal 726*a*, such that the first terminal 724*a* and the second terminal 726*a* form a first connecting terminal. An end of the first terminal 724*b* may be jointed with a hole 7260*b* of the second terminal 726*b*, such that the first terminal 724*b* and the second terminal 726*b* form a second connecting terminal. The jointing manner may be implemented by screw connection or welding. The first connecting terminal or the second connecting terminal may be an integral structure. The terminal base 72 is not limited to up-down structure consisting of the upper base 720 and the lower base 722 and may be left-right structure or front-rear structure according to practical applications. The hole 7260*a* of the second terminal 726*a* is disposed above a hole 7220*a* of the lower base 722 and the hole 7260*b* of the second terminal 726*b* is disposed above a hole 7220*b* of the lower base 722. The first terminal 724*a* passes through a hole 7200*a* of the upper base 720 to be located in an accommodating space 7202*a* and the first terminal 724*b* passes through a hole 7200*b* of the upper base 720 to be located in an accommodating space 7202*b*. An extending portion 7262*a* of the second terminal 726*a* extends downwardly from an edge of the accommodating space 7202*a* to be electrically connected to a wire end 740*a* of the connecting wire 74 and an extending portion 7262*b* of the second terminal 726*b* extends downwardly from an edge of the accommodating space 7202*b* to be electrically connected to a wire end 740*b* of the connecting wire 74. In this embodiment, the connecting wire 74 may be a multi-strand wire, which is covered by an insulation layer and flexible. The connecting wire 74 may be connected to the wire ends 14*a*, 14*b* of the coil 14 and the second terminals 726*a*, 726*b* by metal members. Furthermore, the invention may use two screws 76 to fix the upper base 720 and the lower base 722 on the package casing 70.

As shown in FIG. 18, an outer diameter of the first terminal 724*a* is smaller than or equal to a diameter of the hole 7200*a* of the upper base 720 and an outer diameter of the second terminal 726*a* is larger than the diameter of the hole 7200*a* of the upper base 720. Accordingly, the first terminal 724*a* and the second terminal 726*a* are capable of moving in the accommodating space 7202*a* upwardly and downwardly and the second terminal 726*a* (stop structure) is stopped below the hole 7200*a*. Similarly, an outer diameter of the first terminal 724*b* is smaller than or equal to a diameter of the hole 7200*b* of the upper base 720 and an outer diameter of the second terminal 726*b* is larger than the diameter of the hole 7200*b* of the upper base 720. Accordingly, the first terminal 724*b* and the second terminal 726*b* are capable of moving in the accommodating space 7202*b* upwardly and downwardly and the second terminal 726*b* (stop structure) is stopped below the hole 7200*a*. The shapes of the first terminals 724*a*, 724*b* and the second terminals 726*a*, 726*b* are not limited to specific shapes and may be circular, rectangular, polygonal or oval-shaped.

In some embodiments, the first terminal (or the second terminal) may contact and slide with respect to an inclined surface (not shown) in the accommodating space, such that the first terminal and the second terminal can move in the accommodating space upwardly and downwardly. The outer diameter of the second terminals 726*a*, 726*b* is not limited to be larger than the diameter of the holes 7200*a*, 7200*b* of the upper base 720. For example, the second terminals 726*a*, 726*b* and the holes 7200*a*, 7200*b* of the upper base 720 may be dislocation structures (not shown). That is to say, the second terminals 726*a*, 726*b* and the holes 7200*a*, 7200*b* of the upper base 720 may be dislocated with respect to each other, such that the second terminals 726*a*, 726*b* will abut against the inner of the accommodating spaces 7202*a*, 7202*b* as the first terminal and the second terminal are moving upwardly and downwardly, so as to achieve stop function.

Figure 19:
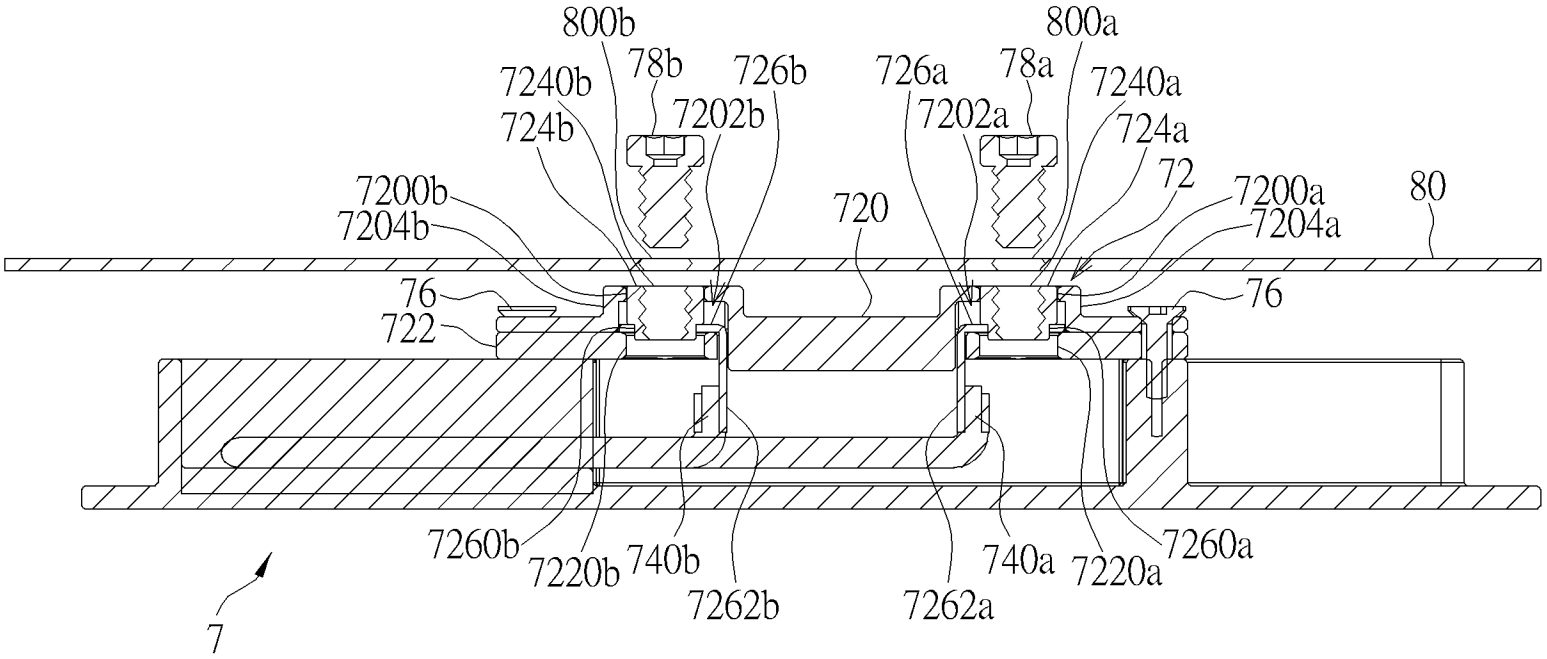
FIG. 19 is a cross-sectional view illustrating the planar reactor shown in FIG. 18, the screws and the circuit board before assembly.
Figure 20:
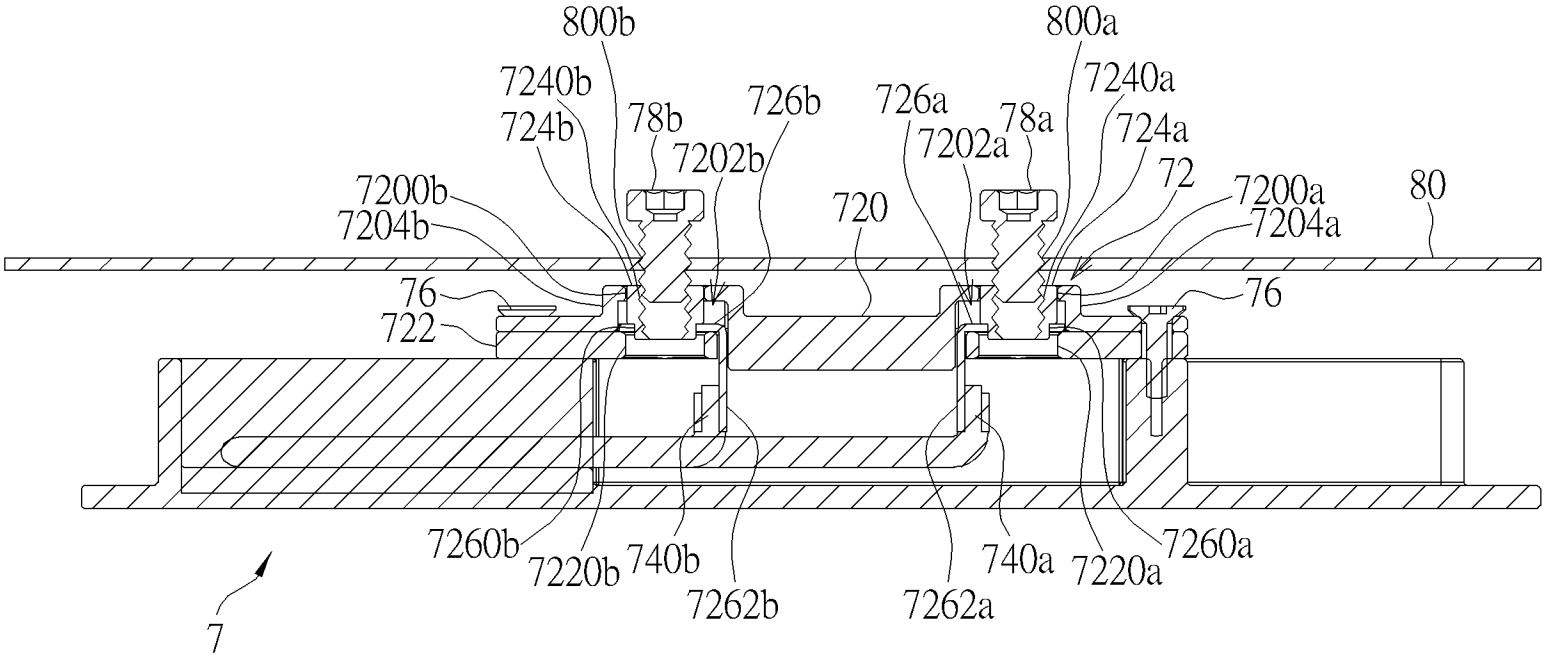
FIG. 20 is a cross-sectional view illustrating the planar reactor shown in FIG. 18, the screws and the circuit board during assembly.
Figure 21:
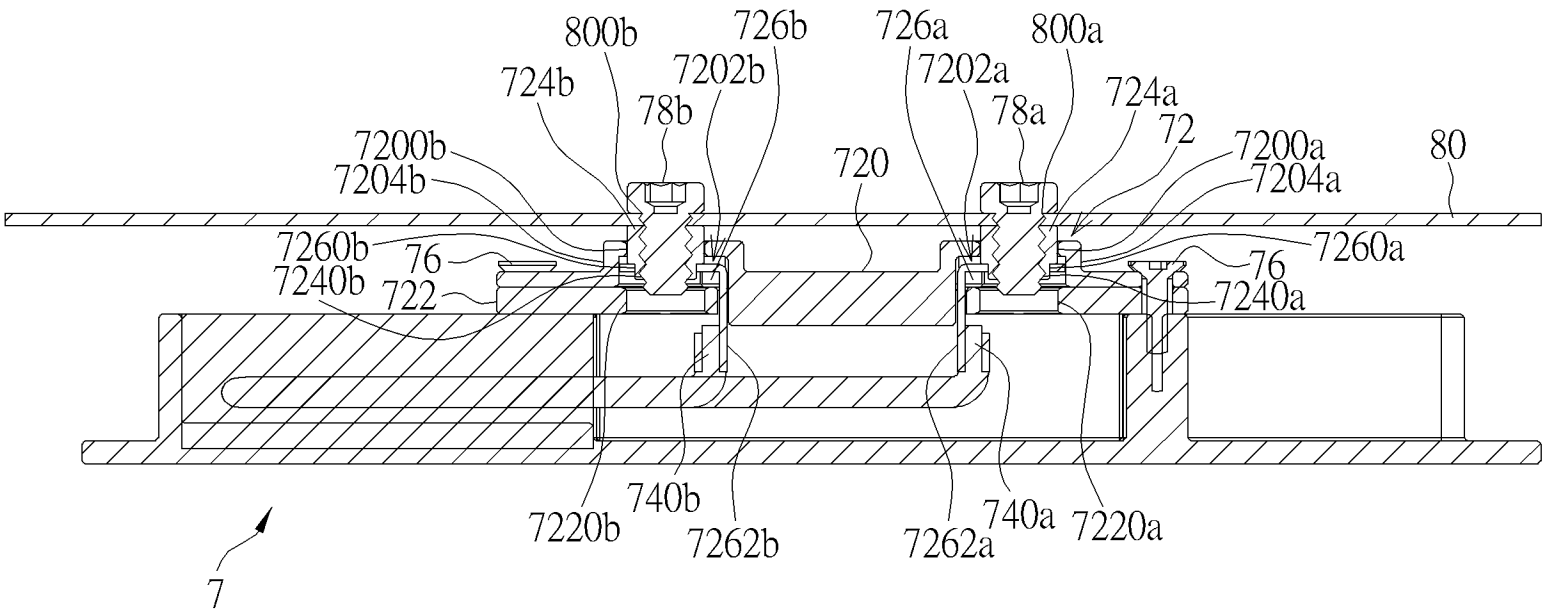
FIG. 21 is a cross-sectional view illustrating the planar reactor shown in FIG. 18, the screws and the circuit board after assembly.

Referring to FIGS. 19 to 21, FIG. 19 is a cross-sectional view illustrating the planar reactor 7 shown in FIG. 18, the screws 78*a*, 78*b* and the circuit board 80 before assembly, FIG. 20 is a cross-sectional view illustrating the planar reactor 7 shown in FIG. 18, the screws 78*a*, 78*b* and the circuit board 80 during assembly, and FIG. 21 is a cross-sectional view illustrating the planar reactor 7 shown in FIG. 18, the screws 78*a*, 78*b* and the circuit board 80 after assembly. As shown in FIGS. 19 to 21, the invention may uses screws 78*a*, 78*b* to electrically connect two terminals of the planar reactor 7 and contacts around two holes 800*a*, 800*b* of the circuit board 80. Before using screws 78*a*, 78*b* to electrically connect two terminals of the planar reactor 7 and contacts around two holes 800*a*, 800*b* of the circuit board 80, the invention may use fixing mechanism (not shown) to fix the planar reactor 7 and the circuit board 80. Afterward, the screws 78*a*, 78*b* are inserted into the holes 800*a*, 800*b* of the circuit board 80, so as to be jointed with the holes 7240*a*, 7240*b* of the first terminals 724*a*, 724*b*, wherein the jointing manner may be screw connection. As shown in FIG. 21, after the screws 78*a*, 78*b* are jointed with the first terminals 724*a*, 724*b*, the first terminals 724*a*, 724*b* moves in the accommodating spaces 7202*a*, 7202*b* upwardly to protrude out of the holes 7200*a*, 7200*b* of the upper base 720 to the contacts on the lower surface of the circuit board 80, such that the first terminals 724*a*, 724*b* are electrically connected to the contacts of the circuit board 80. At this time, the screws 78*a*, 78*b* may extend to a position below the accommodating spaces 7202*a*, 7202*b* or extend to the holes 7220*a*, 7220*b* of the lower base 722. In some embodiments, the holes 7200*a*, 7200*b* of the upper base 720 may be integrated into one single larger hole (not shown), such that the first terminals 724*a*, 724*b* can move in the accommodating spaces 7202*a*, 7202*b* upwardly to protrude out of the larger hole. Similarly, the accommodating spaces 7202*a*, 7202*b* may be integrated into one single larger accommodating space (not shown) and the holes 7220*a*, 7220*b* of the lower base 722 may be integrated into one single larger hole (not shown).

When the first terminals 724*a*, 724*b* move in the accommodating spaces 7202*a*, 7202*b* upwardly to the lower surface of the circuit board 80, the first terminals 724*a*, 724*b* will drive the second terminals 726*a*, 726*b* and the connecting wire 74 to move upwardly. Since the extending portion 7262*a* of the second terminal 726*a* extends downwardly from the edge of the accommodating space 7202*a* to be electrically connected to the wire end 740*a* of the connecting wire 74 and the extending portion 7262*b* of the second terminal 726*b* extends downwardly from the edge of the accommodating space 7202*b* to be electrically connected to the wire end 740*b* of the connecting wire 74, the screws 78*a*, 78*b* will not contact the second terminals 726*a*, 726*b* or the connecting wire 74 while passing through the accommodating spaces 7202*a*, 7202*b* downwardly.

Since the first terminals 724*a*, 724*b* can move upwardly while the screws 78*a*, 78*b* are screwed downwardly, poor contact or stress concentration of the circuit board 80 will not occur even if two distances between the first terminals 724*a*, 724*b* and the circuit board 80 are different.

Figure 22:
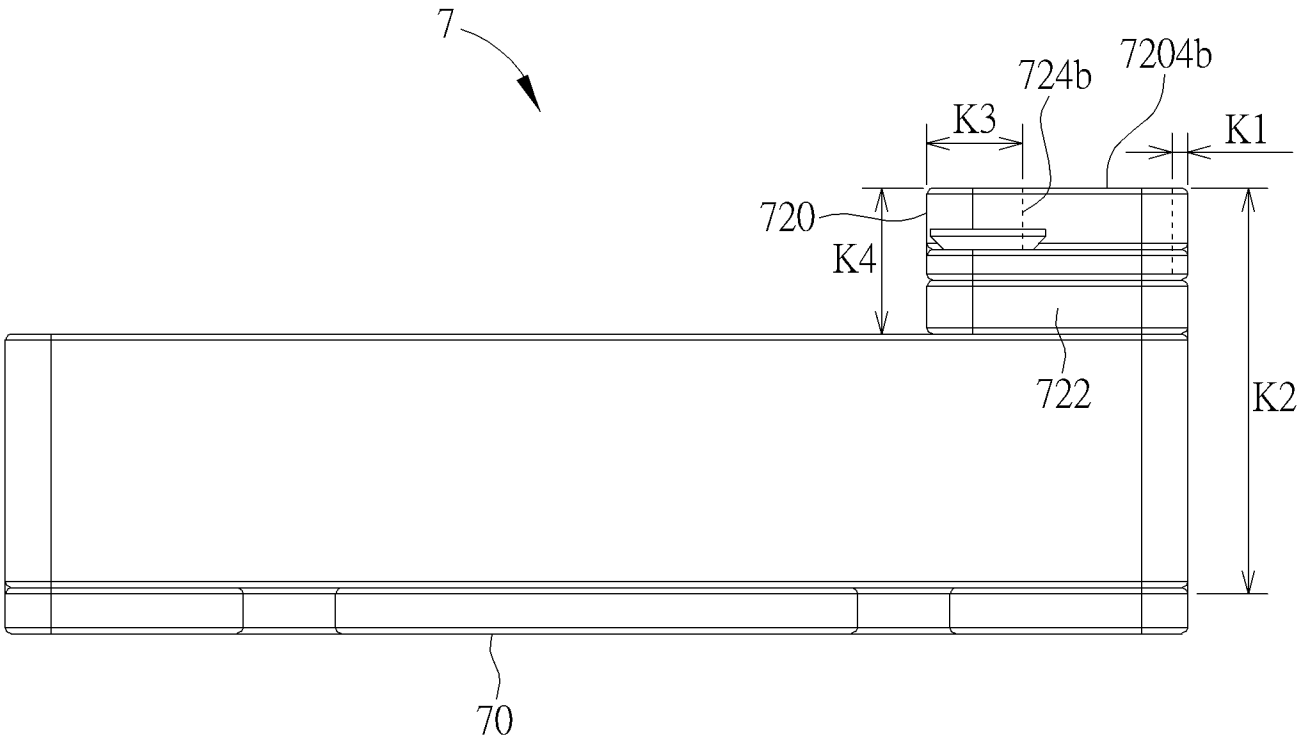
FIG. 22 is a side view illustrating the planar reactor shown in FIG. 16.

Referring to FIG. 22, FIG. 22 is a side view illustrating the planar reactor 7 shown in FIG. 16. As shown in FIG. 16, the upper base 720 may have two protruding structures 7204*a*, 7204*b*, wherein the first terminals 724*a*, 724*b* are disposed in the protruding structures 7204*a*, 7204*b*, respectively. In this embodiment, the protruding structures 7204*a*, 7204*b* and a side plate 7222 downwardly extended from an edge of the lower base 722 can be used to increase an insulation distance between the first terminals 724*a*, 724*b* and the package casing 70 or the core 10, which consists of the lower board 10*a*, the upper board 10*b*, the pillar 12, the first side wall 13*a* and the second side wall 13*b*. The first terminal 724*b* and the protruding structure 7204*b* along with FIGS. 16 and 22 are used to describe the aforesaid feature. As shown in FIGS. 16 and 22, a distance between an edge of the first terminal 724*b* and an outside edge of the protruding structure 7204*b* is defined as a first distance K1, and a distance between an edge of the first terminal 724*b* and an inside edge of the protruding structure 7204*b* is defined as a second distance K3. Furthermore, an outside height of the upper base 720 and the lower base 722 is defined as a first height K2, and an inside height of the upper base 720 and the lower base 722 is defined as a second height K4. As shown in FIG. 22, since the side plate 7222 extends from the edge of the lower base 722 downwardly (i.e. the first height K2 is larger than the second height K4), a sum of the first distance K1 and the first height K2 is larger than a sum of the second distance K3 and the second height K4. Therefore, even if the holes 7200*a*, 7200*b* are arranged close to the outside edge (i.e. the first distance K1 is smaller than the second distance K3), the insulation distance between the first terminal 724*b* and the core 10 (or the package casing 70) can still be increased effectively.

Figure 23:
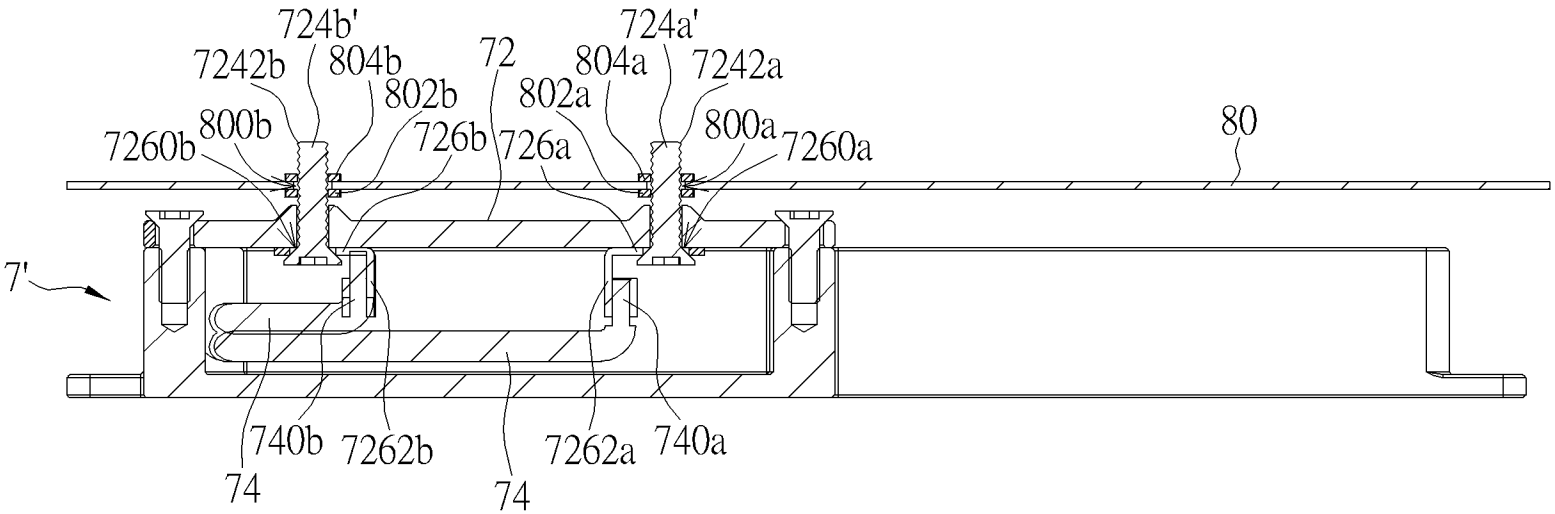
FIG. 23 is a cross-sectional view illustrating a planar reactor according to another embodiment of the invention.

Referring to FIG. 23, FIG. 23 is a cross-sectional view illustrating a planar reactor 7' according to another embodiment of the invention. As shown in FIG. 23, the planar reactor 7' comprises a terminal base 72 and the terminal base 72 comprises two first terminals 724*a*', 724*b*' and two second terminals 726*a*, 726*b*. An end of the first terminal 724*a*' may be jointed with a hole 7260*a* of the second terminal 726*a*, such that the first terminal 724*a*' and the second terminal 726*a* form a first connecting terminal. An end of the first terminal 724*b*' may be jointed with a hole 7260*b* of the second terminal 726*b*, such that the first terminal 724*b*' and the second terminal 726*b* form a second connecting terminal. The jointing manner may be implemented by screw connection or welding. It should be noted that the same elements in FIG. 23 and FIGS. 16-21 are represented by the same numerals, so the repeated explanation will not be depicted herein again.

The main difference between the planar reactor 7' and the aforesaid planar reactor 7 is that, in the planar reactor 7', the first terminals 724*a*', 724*b*' are fixed on the terminal base 72 and screw end 7242*a*, 7242*b* of the first terminals 724*a*', 724*b*' extend out of the terminal base 72, as shown in FIG. 23. In this embodiment, the first terminals 724*a*', 724*b*' may be fixed on the terminal base 72 by screw connection or insert molding. As shown in FIG. 23, the circuit board 80 may be electrically connect to the first terminals 724*a*', 724*b*' of the planar reactor 7'. First of all, the invention disposes nuts 802*a*, 802*b* on the screw ends 7242*a*, 7242*b* of the first terminals 724*a*', 724*b*'. Afterward, the invention inserts the screw ends 7242*a*, 7242*b* of the first terminals 724*a*', 724*b*' into the holes 800*a*, 800*b* of the circuit board 80. Then, the invention disposes nuts 804*a*, 804*b* on the screw ends 7242*a*, 7242*b* of the first terminals 724*a*', 724*b*', such that the circuit board 80 is sandwiched in between the nuts 802*a*, 804*a* and the nuts 802*b*, 804*b*. Accordingly, if the distance between the first terminal 724*a*' and the circuit board 80 is different from the distance between the first terminal 724*b*' and the circuit board 80, the nuts 802*a*, 804*a* and the nuts 802*b*, 804*b* can be screwed upwardly and downwardly to adjust the two distances. Therefore, poor contact or stress concentration of the circuit board 80 will not occur even if the two distances between the first terminals 724*a*', 724*b*' and the circuit board 80 are different. In another embodiment, the nuts 802*a*, 804*a* and the nuts 802*b*, 804*b* may be replaced by solder (e.g. tin or tin alloy), so as to assemble the planar reactor 7' with the circuit board 80 more rapidly and reduce the total height.

Figure 24:
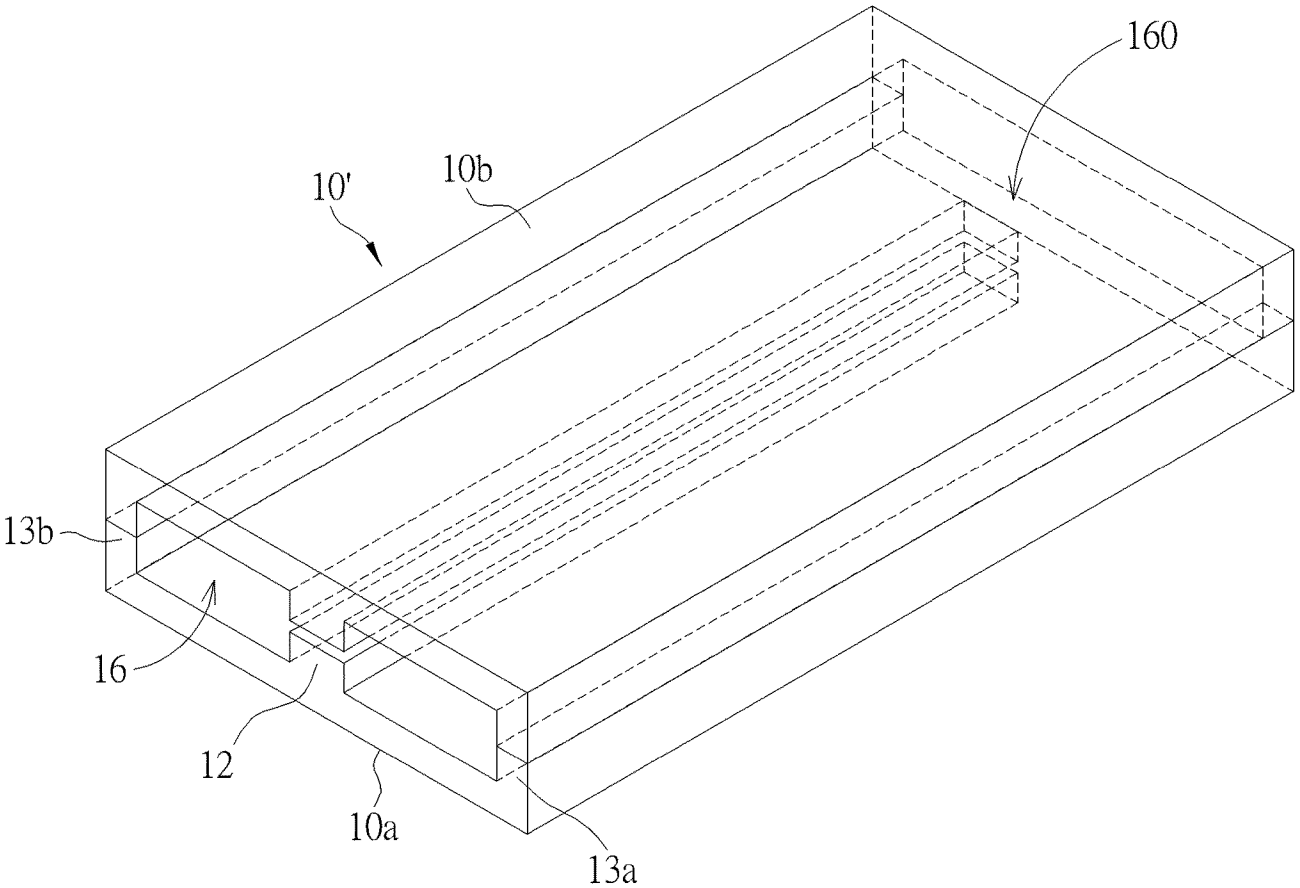
FIG. 24 is a perspective view illustrating a core according to another embodiment of the invention.

Referring to FIG. 24, FIG. 24 is a perspective view illustrating a core 10' according to another embodiment of the invention. As shown in FIG. 24, the core 10' of the invention may be formed as E-E type or symmetry type. It should be noted that, in this embodiment, since the winding space 16 comprises the sunk space 160 located at one side of the pillar 12, the E core comprises a U-shaped portion corresponding to the sunk space 160. The invention may replace the core 10 mentioned in the aforesaid embodiments by the core 10' shown in FIG. 24, so as to be the core of the planar reactor. Furthermore, compared to the core 10 shown in FIG. 4, since the core 10' shown in FIG. 24 consists of two identical cores disposed symmetrically, the number of molds for manufacturing silicon steel sheets for the core 10' may be reduced from three to two while the number of molds for manufacturing silicon steel sheets for the core 10 must be three. It should be noted that the same elements in FIG. 24 and the aforesaid embodiments are represented by the same numerals, so the repeated explanation will not be depicted herein again.

As mentioned in the above, since the pillar and at least one of the upper board and the lower board are coplanar at the first side of the planar reactor and the pillar is sunk into the winding space from the second side of the planar reactor, a sunk space is located at one side of the pillar, such that the width of the pillar can be increased and the length of the pillar can be decreased while the cross-sectional area of the pillar is constant. Accordingly, the ratio of the length to the width of the pillar will decrease. Therefore, the invention can flat the planar reactor and satisfy the requirement of saturation current for the core. Furthermore, since the ratio of the length to the width of the pillar decreases, the winding circumference of the coil will also decrease, so as to reduce the amount and loss of coil. Moreover, since one end of the coil can be hidden in the winding space partially or wholly, the invention can prevent the coil from protruding out of the core to occupy outside space. The invention may dispose the air gap sheet in the air gap between the pillar and the board, so as to reduce noise. In addition, the invention may dispose the heat conducting member at the exposed coil by the pouring sealant, so as to enhance thermal diffusivity and temperature uniformity of the planar reactor.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A planar reactor comprising:

a core comprising:

an upper board;

a lower board; and a pillar located between the upper board and the lower board, a winding space being located among the upper board, the lower board and the pillar;

a coil wound around the pillar and located in the winding space;

a heat conducting member disposed at the first end of the coil extending outside at least one of the upper board and the lower board and overlapping a part of the coil from an innermost ring to an outermost ring; and a pouring sealant covering the coil and a plurality of surfaces of the heat conducting member;

wherein the pillar and at least one of the upper board and the lower board are coplanar at a first side of the planar reactor, the pillar is sunk into the winding space from a second side of the planar reactor, the first side is opposite to the second side, a first end of the coil is exposed from the first side of the planar reactor, a second end of the coil is hidden in the winding space partially or wholly at the second side of the planar reactor, the first end is opposite to the second end.

2. The planar reactor of claim 1, wherein the core further comprises a first side wall and a second side wall, the first side wall and the second side wall are located at opposite sides of the lower board, the pillar is located between the first side wall and the second side wall, the winding space is located among the upper board, the lower board, the pillar, the first side wall and the second side wall.

3. The planar reactor of claim 2, wherein the core of the planar reactor essentially consists of the upper board, the lower board, the pillar, the first side wall and the second side wall and the core of the planar reactor is formed as E-I type, U-T type, F-L type, E-E type or symmetry type.

4. The planar reactor of claim 2, wherein a vertical thickness of the lower board is smaller than a horizontal thickness of the first side wall or a horizontal thickness of the second side wall, or a vertical thickness of the upper board is smaller than the horizontal thickness of the first side wall or the horizontal thickness of the second side wall.

5. The planar reactor of claim 1, wherein a width of the pillar is between 8 mm and 150 mm.

6. The planar reactor of claim 5, wherein a ratio of a length of the pillar to the width of the pillar is between 68.438 and 0.195.

7. The planar reactor of claim 5, wherein the width of the pillar is between 20 mm and 150 mm.

8. The planar reactor of claim 7, wherein a ratio of a length of the pillar to the width of the pillar is between 10.95 and 0.195.

9. The planar reactor of claim 1, wherein the pillar, the upper board and the lower board are coplanar at the first side of the planar reactor.

10. The planar reactor of claim 1, wherein the pillar and one of the upper board and the lower board are coplanar at the first side of the planar reactor, and the other one of the upper board and the lower board extends to overlap with the first end of the coil.

11. The planar reactor of claim 1, further comprising a pouring sealant, the pouring sealant at least covering partial structure of the coil, a thermal conductivity of the core being larger than a thermal conductivity of the pouring sealant.

12. The planar reactor of claim 1, wherein a thermal conductivity of the heat conducting member is larger than a thermal conductivity of the pouring sealant.

13. The planar reactor of claim 1, wherein a thermal conductivity of the heat conducting member is between 100 W/mk and 400 W/mk.

14. The planar reactor of claim 1, wherein the pillar and one of the upper board and the lower board are formed integrally by a stacking manner, an air gap exists between the pillar and the other one of the upper board and the lower board, and the planar reactor further comprises an air gap sheet disposed in the air gap.

15. The planar reactor of claim 14, wherein the air gap sheet is made of insulation material, non-magnetic material or soft material.

16. The planar reactor of claim 1, wherein a total height of the planar reactor is smaller than a total length of the planar reactor and/or a total width of the planar reactor, a ratio of the total height of the planar reactor to the total length of the planar reactor and/or a ratio of the total height of the planar reactor to the total width of the planar reactor is between 1/20 and 1/2.

17. The planar reactor of claim 1, further comprising a terminal base and two connecting wires, the terminal base comprising two connecting terminals, at least one accommodating space and at least one hole, the connecting terminal being disposed in the accommodating space and the hole being disposed above the accommodating space, such that the connecting terminal is capable of moving in the accommodating space to protrude out of the hole of the terminal base, a wire end of the connecting wire being electrically connected to the connecting terminal, another wire end of the connecting wire being electrically connected to the coil.

18. The planar reactor of claim 17, wherein the terminal base comprises an upper base and a lower base, the two connecting terminals comprise two first terminals and two second terminals, an end of the first terminal is jointed with a hole of the second terminal, the hole of the second terminal is disposed above a hole of the lower base, the first terminal passes through a hole of the upper base to be located in the accommodating space, an extending portion of the second terminal extends downwardly from an edge of the accommodating space to be electrically connected to the wire end of the connecting wire, and the another wire end of the connecting wire is electrically connected to the coil.

19. The planar reactor of claim 18, wherein an outer diameter of the first terminal is smaller than or equal to a diameter of the hole of the upper base and an outer diameter of the second terminal is larger than the diameter of the hole of the upper base, or the second terminal and the hole of the upper base are dislocation structures, such that the first terminal and the second terminal are capable of moving in the accommodating space upwardly and downwardly and the second terminal is stopped below the hole of the upper base.

20. The planar reactor of claim 18, wherein the upper base has two protruding structures, the first terminal is disposed in the protruding structure, a distance between an edge of the first terminal and an outside edge of the protruding structure is defined as a first distance, a distance between an edge of the first terminal and an inside edge of the protruding structure is defined as a second distance, an outside height of the upper base and the lower base is defined as a first height, an inside height of the upper base and the lower base is defined as a second height, and a sum of the first distance and the first height is larger than a sum of the second distance and the second height.

21. The planar reactor of claim 1, further comprising a terminal base, the terminal base comprising two connecting terminals, the connecting terminal being fixed on the terminal base and a screw end of the connecting terminal extending out of the terminal base.

22. The planar reactor of claim 1, wherein another surface of the heat conducting member is exposed from the pouring sealant.

23. The planar reactor of claim 1, further comprising a first side board, a second side board, a third side board, a fourth side board and two heat sinks, wherein the two heat sinks are disposed at opposite sides of the lower board and the upper board; the first side board, the second side board, the third side board and the fourth side board are disposed around the lower board and the upper board and fixed with two heat sinks; and the pouring sealant is poured into a space formed between the first side board, the second side board, the third side board and the fourth side board.

* * * * *